US010060451B2

(12) United States Patent
Takahashi et al.

(10) Patent No.: US 10,060,451 B2
(45) Date of Patent: Aug. 28, 2018

(54) HYDRAULIC DRIVE SYSTEM FOR CONSTRUCTION MACHINE

(71) Applicant: Hitachi Construction Machinery Tierra Co., Ltd., Tokyo (JP)

(72) Inventors: Kiwamu Takahashi, Moriyama (JP); Yasutaka Tsuruga, Ryuugasaki (JP); Kazushige Mori, Moriyama (JP); Yoshifumi Takebayashi, Kouka (JP); Natsuki Nakamura, Kouka (JP); Yasuharu Okazaki, Namerikawa (JP); Kenji Yamada, Toyama (JP)

(73) Assignee: Hitachi Construction Machinery Tierra Co., Ltd., Koka-shi (JP)

( * ) Notice: Subject to any disclaimer, the term of this patent is extended or adjusted under 35 U.S.C. 154(b) by 95 days.

(21) Appl. No.: 15/030,383

(22) PCT Filed: Nov. 26, 2014

(86) PCT No.: PCT/JP2014/081147
§ 371 (c)(1),
(2) Date: Apr. 19, 2016

(87) PCT Pub. No.: WO2015/118752
PCT Pub. Date: Aug. 13, 2015

(65) Prior Publication Data

US 2016/0333900 A1 Nov. 17, 2016

(30) Foreign Application Priority Data

Feb. 4, 2014 (JP) ..... 2014-019790

(51) Int. Cl.
*F15B 11/17* (2006.01)
*F15B 13/06* (2006.01)
(Continued)

(52) U.S. Cl.
CPC ..... *F15B 13/06* (2013.01); *E02F 9/2235* (2013.01); *E02F 9/2292* (2013.01);
(Continued)

(58) Field of Classification Search
CPC .. F15B 2211/20576; F15B 2211/20546; E02F 9/2296; E02F 9/2292
See application file for complete search history.

(56) References Cited

U.S. PATENT DOCUMENTS

2004/0020082 A1 2/2004 Ariga et al.
2006/0207248 A1 9/2006 Ariga et al.

FOREIGN PATENT DOCUMENTS

JP 59-194105 A 11/1984
JP 3-7030 B2 1/1991
(Continued)

OTHER PUBLICATIONS

International Search Report (PCT/ISA/210) issued in PCT Application No. PCT/JP2014/081147 dated Mar. 3, 2015 with English translation (5 pages).
(Continued)

*Primary Examiner* — F. Daniel Lopez
*Assistant Examiner* — Daniel Collins
(74) *Attorney, Agent, or Firm* — Crowell & Moring LLP

(57) ABSTRACT

The object is to make it possible to efficiently utilize rated output torque of the prime mover by performing total torque control with high precision through precise detection of absorption torque of the other hydraulic pump by use of a purely hydraulic structure and feedback of the absorption torque to the one hydraulic pump's side. For this purpose, the hydraulic drive system is equipped with: a torque feedback circuit 112*v* which is supplied with delivery pressure of a main pump 202 and load sensing drive pressure, modifies the delivery pressure of the main pump 202 to
(Continued)

achieve a characteristic simulating the absorption torque of the main pump 202, and outputs the modified pressure; and a torque feedback piston 112*f* which is supplied with output pressure of the torque feedback circuit and controls displacement of a main pump 102 so as to decrease the displacement of the main pump 102 and thereby decrease maximum torque T12*max* as the output pressure increases. The torque feedback circuit 112*v* includes first and second variable pressure reducing valves 112*g* and 112*q*.

2 Claims, 11 Drawing Sheets

(51) Int. Cl.
*E02F 9/22* (2006.01)
*F15B 11/16* (2006.01)
*E02F 3/32* (2006.01)

(52) U.S. Cl.
CPC ..... *E02F 9/2296* (2013.01); *F15B 11/161* (2013.01); *F15B 11/17* (2013.01); *E02F 3/325* (2013.01); *E02F 9/2267* (2013.01); *F15B 2211/20507* (2013.01); *F15B 2211/20523* (2013.01); *F15B 2211/20546* (2013.01); *F15B 2211/20553* (2013.01); *F15B 2211/20576* (2013.01); *F15B 2211/253* (2013.01); *F15B 2211/255* (2013.01); *F15B 2211/2656* (2013.01); *F15B 2211/50554* (2013.01); *F15B 2211/6355* (2013.01); *F15B 2211/67* (2013.01)

(56) References Cited

FOREIGN PATENT DOCUMENTS

| | | | |
|---|---|---|---|
| JP | 7-189916 | A | 7/1995 |
| JP | 9-209415 | | 8/1997 |
| JP | 2006-161509 | A | 6/2006 |
| JP | 3865590 | B2 | 10/2006 |
| JP | 2011-196438 | A | 10/2011 |

OTHER PUBLICATIONS

International Preliminary Report on Patentability (PCT/IB/338 & PCT/IB/373) issued in PCT Application No. PCT/JP2014/081147 dated Aug. 18, 2016, including English translation of Japanese-language Written Opinion (PCT/ISA/237), (6 pages).

HYDRAULIC DRIVE SYSTEM FOR CONSTRUCTION MACHINE

TECHNICAL FIELD

The present invention relates to a hydraulic drive system for a construction machine such as a hydraulic excavator. In particular, the present invention relates to a hydraulic drive system for a construction machine having at least two variable displacement hydraulic pumps in which one of the hydraulic pumps includes a pump control unit (regulator) for performing at least torque control and another one of the hydraulic pumps includes a pump control unit (regulator) for performing load sensing control and torque control.

BACKGROUND ART

In hydraulic drive systems for construction machines such as hydraulic excavators, widely used today are those equipped with a regulator for controlling the displacement (flow rate) of a hydraulic pump such that the delivery pressure of the hydraulic pump becomes higher by a target differential pressure than the maximum load pressure of a plurality of actuators. This type of control is called "load sensing control." Such a hydraulic drive system for a construction machine equipped with a regulator for performing the load sensing control is described in Patent Document 1, in which a two-pump load sensing system including two hydraulic pumps each designed to perform the load sensing control is described.

The regulator of a hydraulic drive system for a construction machine performs torque control such that the absorption torque of a hydraulic pump does not exceed the rated output torque of the prime mover and prevents stoppage of the prime mover caused by excessive absorption torque (engine stall), generally by decreasing the displacement of the hydraulic pump as the delivery pressure of the hydraulic pump increases. In cases where the hydraulic drive system is equipped with two hydraulic pumps, the regulator of one hydraulic pump performs the torque control by taking in not only the delivery pressure of its own hydraulic pump but also a parameter regarding the absorption torque of the other hydraulic pump (total torque control) in order to prevent the stoppage of the prime mover and efficiently utilize the rated output torque of the prime mover.

For example, in Patent Document 2, the total torque control is performed by leading the delivery pressure of one hydraulic pump to the regulator of the other hydraulic pump via a pressure reducing valve. The set pressure of the pressure reducing valve is constant and has been set at a value simulating the maximum torque of the torque control of the regulator of the other hydraulic pump. With such features, in work in which only one or more actuators related to the one hydraulic pump are driven, the one hydraulic pump can efficiently use almost all of the rated output torque of the prime mover. Further, in work with a combined operation in which an actuator related to the other hydraulic pump is also driven at the same time, the total absorption torque of the pumps does not exceed the rated output torque of the prime mover and the stoppage of the prime mover can be prevented.

In Patent Document 3, in order to perform the total torque control on two hydraulic pumps of the variable displacement type, the tilting angle of the other hydraulic pump is detected as output pressure of a pressure reducing valve, and the output pressure is led to the regulator of the one hydraulic pump. In Patent Document 4, control precision of the total torque control is increased by detecting the arm length of a pivoting arm in place of the tilting angle of the other hydraulic pump.

PRIOR ART DOCUMENTS

Patent Documents

Patent Document 1: JP-2011-196438-A
Patent Document 2: Japanese Patent No. 3865590
Patent Document 3: JP-1991-007030-B
Patent Document 4: JP-1995-189916-A

SUMMARY OF THE INVENTION

Problem to be Solved by the Invention

The total torque control becomes possible also in the two-pump load sensing system described in Patent Document 1 by incorporating the technology of the total torque control described in Patent Document 2 into the two-pump load sensing system of Patent Document 1. However, in the total torque control in Patent Document 2, the set pressure of the pressure reducing valve has been set at a constant value simulating the maximum torque of the torque control of the other hydraulic pump as mentioned above. Accordingly, the efficient use of the rated output torque of the prime mover can be achieved when the other hydraulic pump is in an operational state of undergoing the limitation by the torque control and operating at the maximum torque of the torque control in the combined operation in which actuators related to the two hydraulic pumps are driven at the same time. However, when the other hydraulic pump is in an operational state of not undergoing the limitation by the torque control and performing the displacement control by means of the load sensing control, even though the absorption torque of the other hydraulic pump is lower than the maximum torque of the torque control, the output pressure of the pressure reducing valve simulating the maximum torque is led to the regulator of the one hydraulic pump and the absorption torque of the one hydraulic pump is erroneously controlled to decrease more than necessary. Thus, it has been impossible to perform the total torque control with high precision.

The technology of Patent Document 3 attempts to increase the precision of the total torque control by detecting the tilting angle of the other hydraulic pump as the output pressure of the pressure reducing valve and leading the output pressure to the regulator of the one hydraulic pump. However, differently from the common method of calculating the torque of a pump as the product of the delivery pressure and the displacement, namely, (delivery pressure× pump displacement)/2π, the system of Patent Document 3 leads the delivery pressure of the one hydraulic pump to one of two pilot chambers of a stepped piston, leads the output pressure of the pressure reducing valve (delivery rate-proportional pressure of the other hydraulic pump) to the other pilot chamber of the stepped piston, and controls the displacement of the one hydraulic pump by using the sum of the delivery pressure and the delivery rate-proportional pressure as the parameter of the output torque. Thus, the technology of Patent Document 3 has a problem in that a considerably great error occurs between the calculated torque and the actually used torque.

In Patent Document 4, the control precision of the total torque control is increased by detecting the arm length of the pivoting arm in place of the tilting angle of the other hydraulic pump. However, the regulator in Patent Document 4 has extremely complex structure in which the pivoting arm and a piston arranged in a regulator piston relatively slide with each other while transmitting force. Thus, in order to make a structure having sufficient durability, components such as the pivoting arm and the regulator piston have to be strengthened and the downsizing of the regulator becomes difficult. Especially in small-sized hydraulic excavators whose rear end radius is small, that is, hydraulic excavators of the so-called small tail swing radius type, the space for storing the hydraulic pumps is small and the installation is difficult in some cases.

The object of the present invention is to provide a hydraulic drive system for a construction machine including at least two variable displacement hydraulic pumps, in which one of the hydraulic pumps includes a pump control unit for performing at least the torque control and the other hydraulic pumps performs the load sensing control and the torque control, capable of efficiently utilizing the rated output torque of the prime mover by performing the total torque control with high precision through precise detection of the absorption torque of the other hydraulic pump by use of a purely hydraulic structure and feedback of the absorption torque to the one hydraulic pump's side.

Means for Solving the Problem (1) To achieve the above object, the present invention provides a hydraulic drive system for a construction machine that includes: a prime mover; a first hydraulic pump of a variable displacement type driven by the prime mover; a second hydraulic pump of the variable displacement type driven by the prime mover; a plurality of actuators driven by a hydraulic fluid delivered by the first and second hydraulic pumps; a plurality of flow control valves that control flow rates of the hydraulic fluid supplied from the first and second hydraulic pumps to the actuators; a plurality of pressure compensating valves each of which controls a differential pressure across a corresponding one of the flow control valves; a first pump control unit that controls a delivery flow rate of the first hydraulic pump; and a second pump control unit that controls a delivery flow rate of the second hydraulic pump. The first pump control unit includes a first torque control section that controls a displacement of the first hydraulic pump in such a manner that an absorption torque of the first hydraulic pump does not exceed a first maximum torque when at least one of a delivery pressure and the displacement of the first hydraulic pump increases and the absorption torque of the first hydraulic pump increases. The second pump control unit includes: a second torque control section that controls a displacement of the second hydraulic pump in such a manner that an absorption torque of the second hydraulic pump does not exceed a second maximum torque when at least one of a delivery pressure and the displacement of the second hydraulic pump increases and the absorption torque of the second hydraulic pump increases; and a load sensing control section that controls the displacement of the second hydraulic pump in such a manner that the delivery pressure of the second hydraulic pump becomes higher by a target differential pressure than a maximum load pressure of the actuators driven by the hydraulic fluid delivered by the second hydraulic pump when the absorption torque of the second hydraulic pump is lower than the second maximum torque. The first torque control section includes: a first torque control actuator that is supplied with the delivery pressure of the first hydraulic pump and controls the displacement of the first hydraulic pump in such a manner that the absorption torque of the first hydraulic pump decreases as the delivery pressure of the first hydraulic pump increases; and first biasing means that sets the first maximum torque. The second torque control section includes: a second torque control actuator that is supplied with the delivery pressure of the second hydraulic pump and controls the displacement of the second hydraulic pump in such a manner that the absorption torque of the second hydraulic pump decreases as the delivery pressure of the second hydraulic pump increases; and second biasing means that sets the second maximum torque. The load sensing control section includes: a control valve that changes a load sensing drive pressure in such a manner that the load sensing drive pressure decreases as a differential pressure between the delivery pressure of the second hydraulic pump and the maximum load pressure decreases below the target differential pressure; and a load sensing control actuator that controls the displacement of the second hydraulic pump in such a manner that the delivery flow rate increases as the load sensing drive pressure decreases. The first pump control unit further includes: a torque feedback circuit that is supplied with the delivery pressure of the second hydraulic pump and the load sensing drive pressure, modifies the delivery pressure of the second hydraulic pump based on the delivery pressure of the second hydraulic pump and the load sensing drive pressure to achieve a characteristic simulating the absorption torque of the second hydraulic pump in both of when the second hydraulic pump operates at the second maximum torque under the control by the second torque control section and when the absorption torque of the second hydraulic pump is lower than the second maximum torque and the load sensing control section controls the displacement of the second hydraulic pump, and outputs the modified pressure; and a third torque control actuator that is supplied with an output pressure of the torque feedback circuit and controls the displacement of the first hydraulic pump so as to decrease the displacement of the first hydraulic pump and thereby decrease the first maximum torque as the output pressure of the torque feedback circuit increases. The torque feedback circuit includes: a first variable pressure reducing valve that is supplied with the delivery pressure of the second hydraulic pump, outputs the delivery pressure of the second hydraulic pump without change when the delivery pressure of the second hydraulic pump is lower than or equal to a first set pressure, and reduces the delivery pressure of the second hydraulic pump to the first set pressure and outputs the reduced pressure when the delivery pressure of the second hydraulic pump is higher than the first set pressure; and a second variable pressure reducing valve that is supplied with the load sensing drive pressure and the delivery pressure of the second hydraulic pump, outputs the load sensing drive pressure without change when the load sensing drive pressure is lower than or equal to a second set pressure, and reduces the load sensing drive pressure to the second set pressure and outputs the reduced pressure when the load sensing drive pressure is higher than the second set pressure, while changing the second set pressure in such a manner that the second set pressure decreases as the delivery pressure of the second hydraulic pump increases. The first variable pressure reducing valve includes a pressure receiving part that is supplied with an output pressure of the second variable pressure reducing valve and changes the first set pressure in such a manner that the first set pressure decreases as the output pressure of the second variable pressure reducing valve increases.

When a hydraulic pump performs the displacement control by means of the load sensing control, the position of a displacement changing member (swash plate) of the hydraulic pump, that is, the displacement (tilting angle) of the hydraulic pump, is determined by the equilibrium between resultant force of two pushing forces applied to the displacement changing member from a load sensing control actuator (LS control piston) on which the load sensing drive pressure acts and from a torque control actuator (torque control piston) on which the delivery pressure of the hydraulic pump acts and pushing force applied to the displacement changing member in the opposite direction from biasing means (spring) used for setting the maximum torque. Therefore, the displacement of the hydraulic pump during the load sensing control changes not only depending on the load sensing drive pressure but also due to the influence of the delivery pressure of the hydraulic pump. The maximum value of the absorption torque of the hydraulic pump at times of increase in the delivery pressure of the hydraulic pump decreases as the load sensing drive pressure increases (see FIGS. 6A and 6B).

In the present invention, the torque feedback circuit is equipped with the first variable pressure reducing valve and is configured such that the set pressure of the first variable pressure reducing valve decreases as the load sensing drive pressure increases. Therefore, the maximum value of the output pressure of the torque feedback circuit at times of increase in the delivery pressure of the second hydraulic pump changes so as to decrease as the load sensing drive pressure increases (FIGS. 5 and 9). The change in the output pressure of the torque feedback circuit corresponds to the change in the maximum value of the absorption torque of the aforementioned hydraulic pump at times of increase in the delivery pressure of the hydraulic pump when the load sensing drive pressure increases (FIG. 6B). With such features, the output pressure of the torque feedback circuit can simulate the change in the maximum value of the absorption torque of the second hydraulic pump when the load sensing drive pressure changes.

Therefore, in the present invention, not only when the second hydraulic pump (the other hydraulic pump) is in an operational state of undergoing the limitation by the torque control and operating at the second maximum torque of the torque control but also when the second hydraulic pump is in an operational state of not undergoing the limitation by the torque control and performing the displacement control by means of the load sensing control, the delivery pressure of the second hydraulic pump is modified by the torque feedback circuit to achieve a characteristic simulating the absorption torque of the second hydraulic pump, and the first maximum torque is modified by the third torque control actuator to decrease by an amount corresponding to the modified delivery pressure. With such features, the absorption torque of the second hydraulic pump is detected precisely by use of a purely hydraulic structure (torque feedback circuit). By feeding back the absorption torque to the first hydraulic pump's side (the one hydraulic pump's side), the total torque control can be performed precisely and the rated output torque of the prime mover can be utilized efficiently.

Each hydraulic pump has a minimum displacement that is determined by the structure of the hydraulic pump. When the hydraulic pump is at the minimum displacement, the absorption torque of the hydraulic pump at times of increase in the delivery pressure of the hydraulic pump increases at a certain gradient (ratio of increase) (FIGS. 5 and 9).

In the present invention, the torque feedback circuit is further equipped with the second variable pressure reducing valve and is configured such that the second set pressure of the second variable pressure reducing valve decreases as the delivery pressure of the second hydraulic pump increases, and the output pressure of the second variable pressure reducing valve is led to the first variable pressure reducing valve in such a manner that the first set pressure of the first variable pressure reducing valve decreases as the output pressure of the second variable pressure reducing valve increases. Therefore, when the second hydraulic pump is at the minimum displacement, the pressure reduced by the second variable pressure reducing valve is led to the first variable pressure reducing valve, and accordingly, the output pressure of the first variable pressure reducing valve takes on a characteristic of proportionally increasing at a prescribed ratio of increase as the delivery pressure of the second hydraulic pump increases (line Z in FIGS. 5 and 9). The change in the output pressure of the first variable pressure reducing valve corresponds to the aforementioned change in the absorption torque of the second hydraulic pump when the second hydraulic pump is at the minimum displacement (FIG. 6B). Accordingly, the output pressure of the torque feedback circuit takes on a characteristic simulating the change in the absorption torque of the second hydraulic pump when the second hydraulic pump is at the minimum displacement.

With such features, the total torque consumption of the first and second hydraulic pumps does not become excessive and the stoppage of the prime mover can be prevented in the combined operation of an actuator related to the first hydraulic pump and an actuator related to the second hydraulic pump in which the load pressure of the actuator related to the second hydraulic pump becomes high and the demanded flow rate is extremely low (e.g., combined operation of boom raising fine operation and swing operation or arm operation in load lifting work).

(2) Preferably, in the above hydraulic drive system (1), the torque feedback circuit further includes a restrictor that is provided in a hydraulic line for leading the load sensing drive pressure to the second variable pressure reducing valve to absorb vibration of the load sensing drive pressure thereby to stabilize the pressure when the load sensing drive pressure is vibrational.

With such features, the output pressure of the torque feedback circuit is stabilized and the total torque control can be performed with higher precision.

Effect of the Invention

According to the present invention, not only when the second hydraulic pump (the other hydraulic pump) is in the operational state of undergoing the limitation by the torque control and operating at the second maximum torque of the torque control but also when the second hydraulic pump is in the operational state of not undergoing the limitation by the torque control and performing the displacement control by means of the load sensing control, the delivery pressure of the second hydraulic pump is modified by the torque feedback circuit to achieve a characteristic simulating the absorption torque of the second hydraulic pump, and the first maximum torque is modified by the third torque control actuator to decrease by an amount corresponding to the modified delivery pressure. With such features, the absorption torque of the second hydraulic pump is detected precisely by use of a purely hydraulic structure (torque feedback circuit). By feeding back the absorption torque to the first hydraulic pump's side (the one hydraulic pump's side), the total torque control can be performed precisely and the rated output torque of the prime mover can be utilized efficiently.

MODE FOR CARRYING OUT THE INVENTION

Figure 1:
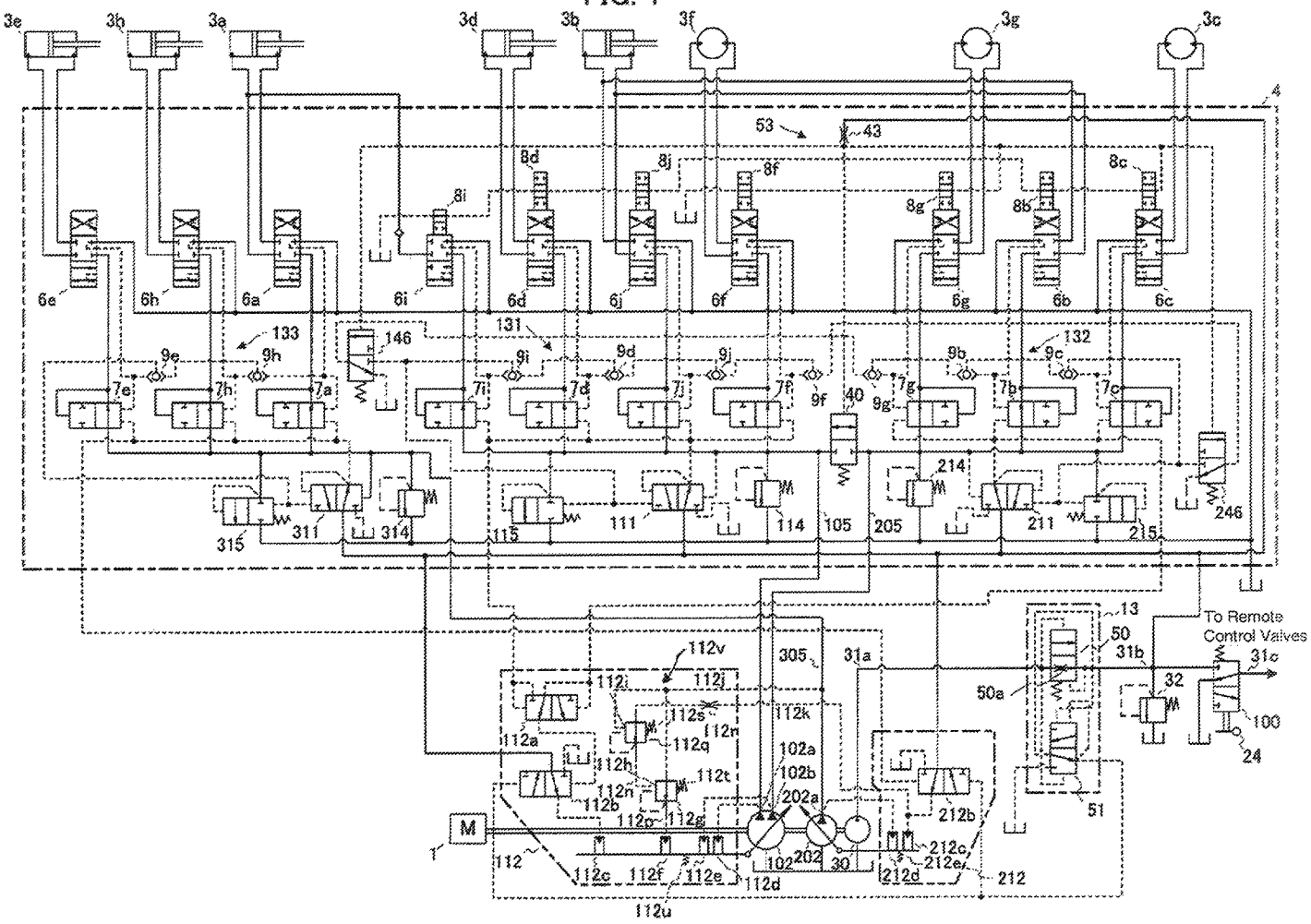
FIG. 1 is a schematic diagram showing a hydraulic drive system for a hydraulic excavator (construction machine) in accordance with an embodiment of the present invention.

Referring now to the drawings, a description will be given in detail of a preferred embodiment of the present invention.

First Embodiment

Structure

FIG. 1 is a schematic diagram showing a hydraulic drive system for a hydraulic excavator (construction machine) in accordance with a first embodiment of the present invention.

Referring to FIG. 1, the hydraulic drive system according to this embodiment includes a prime mover 1 (e.g., diesel engine), a main pump 102 (first hydraulic pump), a main pump 202 (second hydraulic pump), actuators 3*a*, 3*b*, 3*c*, 3*d*, 3*e*, 3*f*, 3*g* and 3*h*, a control valve unit 4, a regulator 112 (first pump control unit), and a regulator 212 (second pump control unit). The main pumps 102 and 202 are driven by the prime mover 1. The main pump 102 (first pump device) is a variable displacement pump of the split flow type having first and second delivery ports 102*a* and 102*b* for delivering the hydraulic fluid to first and second hydraulic fluid supply lines 105 and 205. The main pump 202 (second pump device) is a variable displacement pump of the single flow type having a third delivery port 202*a* for delivering the hydraulic fluid to a third hydraulic fluid supply line 305. The actuators 3*a*, 3*b*, 3*c*, 3*d*, 3*e*, 3*f*, 3*g* and 3*h* are driven by the hydraulic fluid delivered from the first and second delivery ports 102*a* and 102*b* of the main pump 102 and the third delivery port 202*a* of the main pump 202. The control valve unit 4 is connected to the first through third hydraulic fluid supply lines 105, 205 and 305 and controls the flow of the hydraulic fluid supplied from the first and second delivery ports 102*a* and 102*b* of the main pump 102 and the third delivery port 202*a* of the main pump 202 to the actuators 3*a*, 3*b*, 3*c*, 3*d*, 3*e*, 3*f*, 3*g* and 3*h*. The regulator 112 (first pump control unit) is used for controlling the delivery flow rates of the first and second delivery ports 102*a* and 102*b* of the main pump 102. The regulator 212 (second pump control unit) is used for controlling the delivery flow rate of the third delivery port 202*a* of the main pump 202.

The control valve unit 4 includes flow control valves 6*a*, 6*b*, 6*c*, 6*d*, 6*e*, 6*f*, 6*g*, 6*h*, 6*i* and 6*j*, pressure compensating valves 7*a*, 7*b*, 7*c*, 7*d*, 7*e*, 7*f*, 7*g*, 7*h*, 7*i* and 7*j*, operation detection valves 8*b*, 8*c*, 8*d*, 8*f*, 8*g*, 8*i* and 8*j*, main relief valves 114, 214 and 314, and unloading valves 115, 215 and 315. The flow control valves 6*a*, 6*b*, 6*c*, 6*d*, 6*e*, 6*f*, 6*g*, 6*h*, 6*i* and 6*j* are connected to the first through third hydraulic fluid supply lines 105, 205 and 305 and control the flow rates of the hydraulic fluid supplied to the actuators 3*a*-3*h* from the first and second delivery ports 102*a* and 102*b* of the main pump 102 and the third delivery port 202*a* of the main pump 202. Each pressure compensating valve 7*a*-7*j* controls the differential pressure across a corresponding flow control valve 6*a*-6*j* such that the differential pressure becomes equal to a target differential pressure. Each operation detection valve 8*b*, 8*c*, 8*d*, 8*f*, 8*g*, 8*i*, 8*j* strokes together with the spool of a corresponding one of the flow control valves 6*a*-6*j* in order to detect the switching of the flow control valve. The main relief valve 114 is connected to the first hydraulic fluid supply line 105 and controls the pressure in the first hydraulic fluid supply line 105 such that the pressure does not reach or exceed a set pressure. The main relief valve 214 is connected to the second hydraulic fluid supply line 205 and controls the pressure in the second hydraulic fluid supply line 105 such that the pressure does not reach or exceed a set pressure. The main relief valve 314 is connected to the third hydraulic fluid supply line 305 and controls the pressure in the third hydraulic fluid supply line 305 such that the pressure does not reach or exceed a set pressure. The unloading valve 115 is connected to the first hydraulic fluid supply line 105. When the pressure in the first hydraulic fluid supply line 105 becomes higher than a pressure (unloading valve set pressure) defined as the sum of the maximum load pressure of the actuators driven by the hydraulic fluid delivered from the first delivery port 102*a* and a set pressure (prescribed pressure) of its own spring, the unloading valve 115 shifts to the open state and returns the hydraulic fluid in the first hydraulic fluid supply line 105 to a tank. The unloading valve 215 is connected to the second hydraulic fluid supply line 205. When the pressure in the second hydraulic fluid supply line 205 becomes higher than a pressure (unloading valve set pressure) defined as the sum of the maximum load pressure of the actuators driven by the hydraulic fluid delivered from the second delivery port 102*b* and a set pressure (prescribed pressure) of its own spring, the unloading valve 215 shifts to the open state and returns the hydraulic fluid in the second hydraulic fluid supply line 205 to the tank. The unloading valve 315 is connected to the third hydraulic fluid supply line 305. When the pressure in the third hydraulic fluid supply line 305 becomes higher than a pressure (unloading valve set pressure) defined as the sum of the maximum load pressure of the actuators driven by the hydraulic fluid delivered from the third delivery port 202*a* and a set pressure (prescribed pressure) of its own spring, the unloading valve 315 shifts to the open state and returns the hydraulic fluid in the third hydraulic fluid supply line 305 to the tank.

The control valve unit 4 further includes a first load pressure detection circuit 131, a second load pressure detection circuit 132, a third load pressure detection circuit 133, and differential pressure reducing valves 111, 211 and 311. The first load pressure detection circuit 131 includes shuttle valves 9*d*, 9*f*, 9*i* and 9*j* which are connected to load ports of the flow control valves 6*d*, 6*f*, 6*i* and 6*j* connected to the first hydraulic fluid supply line 105 in order to detect the maximum load pressure Plmax1 of the actuators 3*a*, 3*b*, 3*d* and 3*f*. The second load pressure detection circuit 132 includes shuttle valves 9*b*, 9*c* and 9*g* which are connected to load ports of the flow control valves 6*b*, 6*c* and 6*g* connected to the second hydraulic fluid supply line 205 in order to detect the maximum load pressure Plmax2 of the actuators 3*b*, 3*c* and 3*g*. The third load pressure detection circuit 133 includes shuttle valves 9*e* and 9*h* which are connected to load ports of the flow control valves 6*a*, 6*e* and 6*h* connected to the third hydraulic fluid supply line 305 in order to detect the load pressure (maximum load pressure) Plmax3 of the actuators 3*a*, 3*e* and 3*h*. The differential pressure reducing valve 111 outputs the difference (LS differential pressure) between the pressure P1 in the first hydraulic fluid supply line 105 (i.e., the pressure in the first delivery port 102*a*) and the maximum load pressure Plmax1 detected by the first load pressure detection circuit 131 (i.e., the maximum load pressure of the actuators 3*a*, 3*b*, 3*d* and 3*f* connected to the first hydraulic fluid supply line 105) as absolute pressure Pls1. The differential pressure reducing valve 211 outputs the difference (LS differential pressure) between the pressure P2 in the second hydraulic fluid supply line 205 (i.e., the pressure in the second delivery port 102*b*) and the maximum load pressure Plmax2 detected by the second load pressure detection circuit 132 (i.e., the maximum load pressure of the actuators 3*b*, 3*c* and 3*g* connected to the second hydraulic fluid supply line 205) as absolute pressure Pls2. The differential pressure reducing valve 311 outputs the difference (LS differential pressure) between the pressure P3 in the third hydraulic fluid supply line 305 (i.e., the delivery pressure of the main pump 202 or the pressure in the third delivery port 202*a*) and the maximum load pressure Plmax3 detected by the third load pressure detection circuit 133 (i.e., the load pressure of the actuators 3*a*, 3*e* and 3*h* connected to the third hydraulic fluid supply line 305) as absolute pressure Pls3. The absolute pressures Pls1, Pls2 and Pls3 outputted by the differential pressure reducing valves 111, 211 and 311 will hereinafter be referred to as LS differential pressures Pls1, Pls2 and Pls3 as needed.

To the aforementioned unloading valve 115, the maximum load pressure Plmax1 detected by the first load pressure detection circuit 131 is led as the maximum load pressure of the actuators driven by the hydraulic fluid delivered from the first delivery port 102*a*. To the aforementioned unloading valve 215, the maximum load pressure Plmax2 detected by the second load pressure detection circuit 132 is led as the maximum load pressure of the actuators driven by the hydraulic fluid delivered from the second delivery port 102*b*. To the aforementioned unloading valve 315, the maximum load pressure Plmax3 detected by the third load pressure detection circuit 133 is led as the maximum load pressure of the actuators driven by the hydraulic fluid delivered from the third delivery port 202*a*.

The LS differential pressure Pls1 outputted by the differential pressure reducing valve 111 is led to the pressure compensating valves 7*d*, 7*f*, 7*i* and 7*j* connected to the first hydraulic fluid supply line 105 and to the regulator 112 of the main pump 102. The LS differential pressure Pls2 outputted by the differential pressure reducing valve 211 is led to the pressure compensating valves 7*b*, 7*c* and 7*g* connected to the second hydraulic fluid supply line 205 and to the regulator 112 of the main pump 102. The LS differential pressure Pls3 outputted by the differential pressure reducing valve 311 is led to the pressure compensating valves 7*a*, 7*e* and 7*h* connected to the third hydraulic fluid supply line 305 and to the regulator 212 of the main pump 202.

The actuator 3*a* is connected to the first delivery port 102*a* via the flow control valve 6*i*, the pressure compensating valve 7*i* and the first hydraulic fluid supply line 105, and to the third delivery port 202*a* via the flow control valve 6*a*, the pressure compensating valve 7*a* and the third hydraulic fluid supply line 305. The actuator 3*a* is a boom cylinder for driving a boom of the hydraulic excavator, for example. The flow control valve 6*a* is used for the main driving of the boom cylinder 3*a*, while the flow control valve 6*i* is used for the assist driving of the boom cylinder 3*a*. The actuator 3*b* is connected to the first delivery port 102*a* via the flow control valve 6*j*, the pressure compensating valve 7*j* and the first hydraulic fluid supply line 105, and to the second delivery port 102*b* via the flow control valve 6*b*, the pressure compensating valve 7*b* and the second hydraulic fluid supply line 205. The actuator 3*b* is an arm cylinder for driving an arm of the hydraulic excavator, for example. The flow control valve 6*b* is used for the main driving of the arm cylinder 3*b*, while the flow control valve 6*j* is used for the assist driving of the arm cylinder 3*b*.

The actuators 3*d* and 3*f* are connected to the first delivery port 102*a* via the flow control valves 6*d* and 6*f*, the pressure compensating valves 7*d* and 7*f* and the first hydraulic fluid supply line 105, respectively. The actuators 3*c* and 3*g* are connected to the second delivery port 102*b* via the flow control valves 6*c* and 6*g*, the pressure compensating valves 7*c* and 7*g* and the second hydraulic fluid supply line 205, respectively. The actuators 3*d* and 3*f* are, for example, a bucket cylinder for driving a bucket of the hydraulic excavator and a left travel motor for driving a left crawler of a lower track structure of the hydraulic excavator, respectively. The actuators 3*c* and 3*g* are, for example, a swing motor for driving an upper swing structure of the hydraulic excavator and a right travel motor for driving a right crawler of the lower track structure of the hydraulic excavator, respectively. The actuators 3*e* and 3*h* are connected to the third delivery port 102*a* via the flow control valves 6*e* and 6*h*, the pressure compensating valves 7*e* and 7*h* and the third hydraulic fluid supply line 305, respectively. The actuators 3*e* and 3*h* are, for example, a swing cylinder for driving a swing post of the hydraulic excavator and a blade cylinder for driving a blade of the hydraulic excavator, respectively.

Figure 2A:
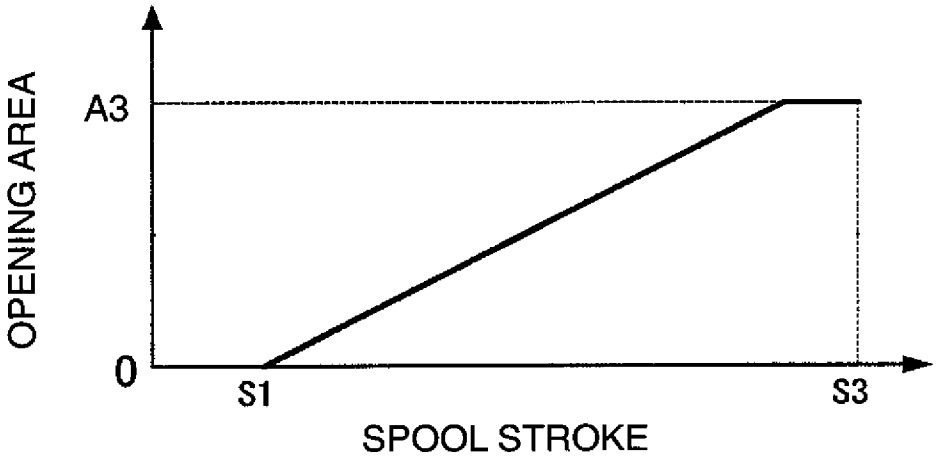
FIG. 2A is a diagram showing the opening area characteristic of a meter-in channel of a flow control valve of each actuator other than a boom cylinder or an arm cylinder.

FIG. 2A is a diagram showing the opening area characteristic of the meter-in channel of the flow control valve 6*c*-6*h* of each actuator 3*c*-3*h* other than the actuator 3*a* as the boom cylinder (hereinafter referred to as a "boom cylinder 3*a*" as needed) or the actuator 3*b* as the arm cylinder (hereinafter referred to as an "arm cylinder 3*b*" as needed). The opening area characteristic of these flow control valves has been set such that the opening area increases as the spool stroke increases beyond the dead zone 0-S1 and the opening area reaches the maximum opening area A3 just before the spool stroke reaches the maximum spool stroke S3. The maximum opening area A3 has a specific value (size) depending on the type of each actuator.

Figure 2B:
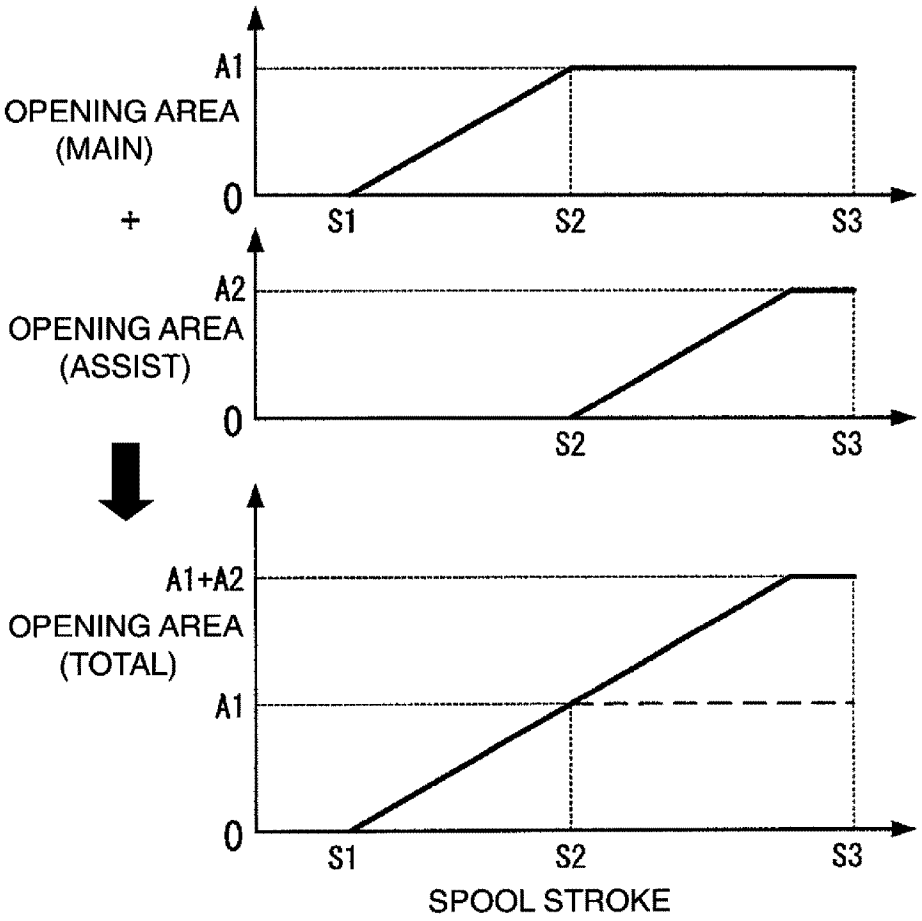
FIG. 2B is a diagram showing the opening area characteristic of the meter-in channel of each of main and assist flow control valves of the boom cylinder and main and assist flow control valves of the arm cylinder (upper part) and the combined opening area characteristic of the meter-in channels of the main and assist flow control valves of the boom cylinder and the main and assist flow control valves of the arm cylinder (lower part).

The upper part of FIG. 2B shows the opening area characteristic of the meter-in channel of each of the flow control valves 6*a* and 6*i* of the boom cylinder 3*a* and the flow control valves 6*b* and 6*j* of the arm cylinder 3*b*.

The opening area characteristic of the flow control valve 6*a* for the main driving of the boom cylinder 3*a* has been set such that the opening area increases as the spool stroke increases beyond the dead zone 0-S1, the opening area reaches the maximum opening area A1 at an intermediate stroke S2, and thereafter the maximum opening area A1 is maintained until the spool stroke reaches the maximum spool stroke S3. The opening area characteristic of the flow control valve 6*b* for the main driving of the arm cylinder 3*b* has also been set similarly.

The opening area characteristic of the flow control valve 6*i* for the assist driving of the boom cylinder 3*a* has been set such that the opening area remains at zero until the spool stroke reaches an intermediate stroke S2, increases as the spool stroke increases beyond the intermediate stroke S2, and reaches the maximum opening area A2 just before the spool stroke reaches the maximum spool stroke S3. The opening area characteristic of the flow control valve 6*j* for the assist driving of the arm cylinder 3*b* has also been set similarly.

The lower part of FIG. 2B shows the combined opening area characteristic of the meter-in channels of the flow control valves 6*a* and 6*i* of the boom cylinder 3*a* and the flow control valves 6*b* and 6*j* of the arm cylinder 3*b*.

The meter-in channel of each flow control valve 6*a*, 6*i* of the boom cylinder 3*a* has the opening area characteristic explained above. Consequently, the meter-in channels of the flow control valves 6*a* and 6*i* of the boom cylinder 3*a* have a combined opening area characteristic in which the opening area increases as the spool stroke increases beyond the dead zone 0-S1 and the opening area reaches the maximum opening area A1+A2 just before the spool stroke reaches the maximum spool stroke S3. The combined opening area characteristic of the flow control valves 6*b* and 6*j* of the arm cylinder 3*b* has also been set similarly.

Here, the maximum opening area A3 regarding the flow control valves 6*c*, 6*d*, 6*e*, 6*f*, 6*g* and 6*h* of the actuators 3*c*-3*h* shown in FIG. 2A and the combined maximum opening area A1+A2 regarding the flow control valves 6*a* and 6*i* of the boom cylinder 3*a* and the flow control valves 6*b* and 6*j* of the arm cylinder 3*b* satisfy a relationship A1+A2>A3. In other words, the boom cylinder 3*a* and the arm cylinder 3*b* are actuators whose maximum demanded flow rates are high compared to the other actuators.

Returning to FIG. 1, the control valve 4 further includes a travel combined operation detection hydraulic line 53, a first selector valve 40, a second selector valve 146, and a third selector valve 246. The travel combined operation detection hydraulic line 53 is a hydraulic line whose upstream side is connected to a pilot hydraulic fluid supply line 31*b* (explained later) via a restrictor 43 and whose downstream side is connected to the tank via the operation detection valves 8*a*, 8*b*, 8*c*, 8*d*, 8*f*, 8*g*, 8*i* and 8*j*. The first selector valve 40, the second selector valve 146 and the third selector valve 246 are switched according to an operation detection pressure generated by the travel combined operation detection hydraulic line 53.

At times other than a travel combined operation for driving the actuator 3*f* as the left travel motor (hereinafter referred to as a "left travel motor 3*f*" as needed) and/or the actuator 3*g* as the right travel motor (hereinafter referred to as a "right travel motor 3*g*" as needed) and at least one of the actuators 3*a*, 3*b*, 3*c* and 3*d* other than the left and right travel motors connected to the first or second hydraulic fluid supply line 105 or 205 at the same time, the travel combined operation detection hydraulic line 53 is connected to the tank via at least one of the operation detection valves 8*a*, 8*b*, 8*c*, 8*d*, 8*f*, 8*g*, 8*i* and 8*j*, by which the pressure in the hydraulic line 53 becomes equal to the tank pressure. When the travel combined operation is performed, the operation detection valves 8*f* and 8*g* and at least one of the operation detection valves 8*a*, 8*b*, 8*c*, 8*d*, 8*i* and 8*j* stroke together with corresponding flow control valves and the communication between the travel combined operation detection hydraulic line 53 and the tank is interrupted, by which the operation detection pressure (operation detection signal) is generated in the hydraulic line 53.

When the travel combined operation is not performed, the first selector valve 40 is positioned at a first position (interruption position) as the lower position in FIG. 1 and interrupts the communication between the first hydraulic fluid supply line 105 and the second hydraulic fluid supply line 205. When the travel combined operation is performed, the first selector valve 40 is switched to a second position (communication position) as the upper position in FIG. 1 by the operation detection pressure generated in the travel combined operation detection hydraulic line 53 and brings the first hydraulic fluid supply line 105 and the second hydraulic fluid supply line 205 into communication with each other.

When the travel combined operation is not performed, the second selector valve 146 is positioned at a first position as the lower position in FIG. 1 and leads the tank pressure to the shuttle valve 9*g* at the downstream end of the second load pressure detection circuit 132. When the travel combined operation is performed, the second selector valve 146 is switched to a second position as the upper position in FIG. 1 by the operation detection pressure generated in the travel combined operation detection hydraulic line 53 and leads the maximum load pressure Plmax1 detected by the first load pressure detection circuit 131 (the maximum load pressure of the actuators 3*a*, 3*b*, 3*d* and 3*f* connected to the first hydraulic fluid supply line 105) to the shuttle valve 9*g* at the downstream end of the second load pressure detection circuit 132.

When the travel combined operation is not performed, the third selector valve 246 is positioned at a first position as the lower position in FIG. 1 and leads the tank pressure to the shuttle valve 9*f* at the downstream end of the first load pressure detection circuit 131. When the travel combined operation is performed, the third selector valve 246 is switched to a second position as the upper position in FIG. 1 by the operation detection pressure generated in the travel combined operation detection hydraulic line 53 and leads the maximum load pressure Plmax2 detected by the second load pressure detection circuit 132 (the maximum load pressure of the actuators 3*b*, 3*c* and 3*g* connected to the second hydraulic fluid supply line 205) to the shuttle valve 9*f* at the downstream end of the first load pressure detection circuit 131.

Incidentally, the left travel motor 3*f* and the right travel motor 3*g* are actuators driven at the same time and achieving a prescribed function by having supply flow rates equivalent to each other when driven at the same time. In this embodiment, the left travel motor 3*f* is driven by the hydraulic fluid delivered from the first delivery port 102*a* of the split flow type main pump 102, while the right travel motor 3*g* is driven by the hydraulic fluid delivered from the second delivery port 102*b* of the split flow type main pump 102.

Figure 7:
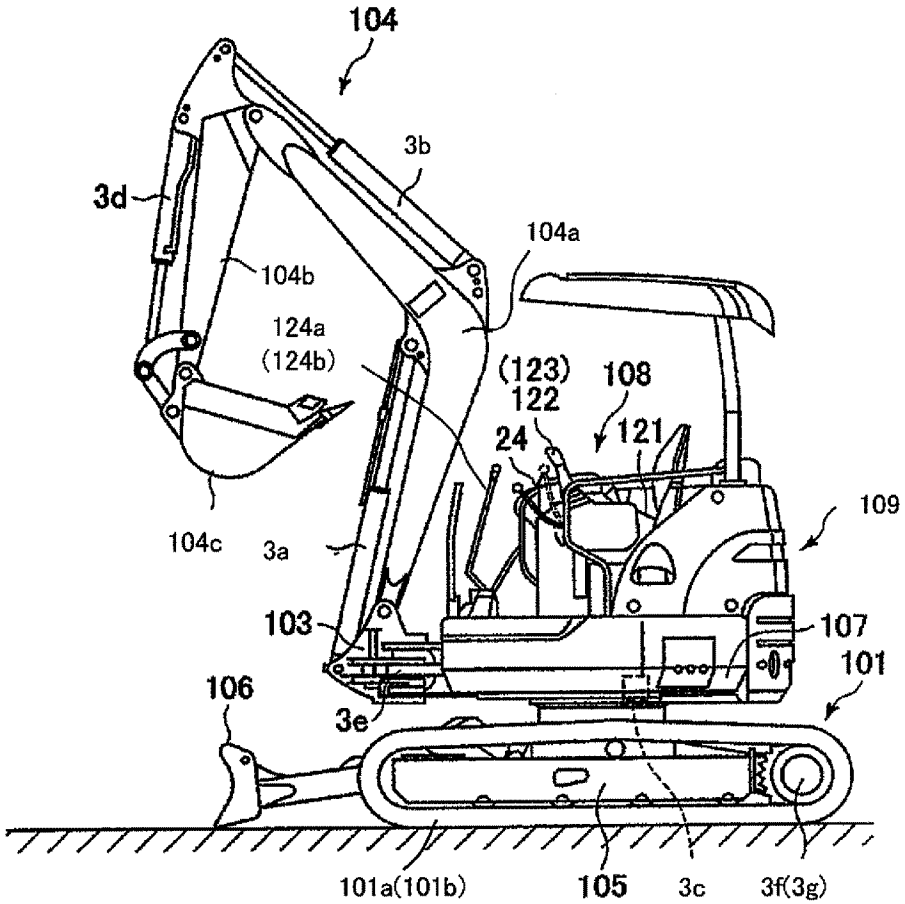
FIG. 7 is a schematic diagram showing the external appearance of the hydraulic excavator in which the hydraulic drive system is installed.

In FIG. 1, the hydraulic drive system in this embodiment further includes a pilot pump 30, a prime mover revolution speed detection valve 13, a pilot relief valve 32, a gate lock valve 100, and operating devices 122, 123, 124*a* and 124*b* (FIG. 7). The pilot pump 30 is a fixed displacement pump driven by the prime mover 1. The prime mover revolution speed detection valve 13 is connected to a hydraulic fluid supply line 31*a* of the pilot pump 30 and detects the delivery flow rate of the pilot pump 30 as absolute pressure Pgr. The pilot relief valve 32 is connected to the pilot hydraulic fluid supply line 31*b* downstream of the prime mover revolution speed detection valve 13 and generates a constant pilot primary pressure Ppilot in the pilot hydraulic fluid supply line 31*b*. The gate lock valve 100 is connected to the pilot hydraulic fluid supply line 31*b* and performs switching regarding whether to connect a hydraulic fluid supply line 31*c* on the downstream side to the pilot hydraulic fluid supply line 31*b* or to the tank depending on the position of a gate lock lever 24. The operating devices 122, 123, 124*a* and 124*b* (FIG. 7) include pilot valves (pressure reducing valves) which are connected to the pilot hydraulic fluid supply line 31*c* downstream of the gate lock valve 100 to generate operating pilot pressures used for controlling the flow control valves 6*a*, 6*b*, 6*c*, 6*d*, 6*e*, 6*f*, 6*g* and 6*h* which will be explained later.

The prime mover revolution speed detection valve 13 includes a flow rate detection valve 50 which is connected between the hydraulic fluid supply line 31*a* of the pilot pump 30 and the pilot hydraulic fluid supply line 31*b* and a differential pressure reducing valve 51 which outputs the differential pressure across the flow rate detection valve 50 as absolute pressure Pgr.

The flow rate detection valve 50 includes a variable restrictor part 50*a* whose opening area increases as the flow rate therethrough (delivery flow rate of the pilot pump 30) increases. The hydraulic fluid delivered from the pilot pump 30 passes through the variable restrictor part 50*a* of the flow rate detection valve 50 and then flows to the pilot hydraulic line 31*b*'s side. In this case, a differential pressure increasing with the increase in the flow rate occurs across the variable restrictor part 50*a* of the flow rate detection valve 50. The differential pressure reducing valve 51 outputs the differential pressure across the variable restrictor part 50*a* as the absolute pressure Pgr. Since the delivery flow rate of the pilot pump 30 changes according to the revolution speed of the prime mover 1, the delivery flow rate of the pilot pump 30 and the revolution speed of the prime mover 1 can be detected by the detection of the differential pressure across the variable restrictor part 50*a*. The absolute pressure Pgr outputted by the prime mover revolution speed detection valve 13 (differential pressure reducing valve 51) is led to the regulators 112 and 212 as target LS differential pressure. The absolute pressure Pgr outputted by the differential pressure reducing valve 51 will hereinafter be referred to as "output pressure Pgr" or "target LS differential pressure Pgr" as needed.

The regulator 112 (first pump control unit) includes a low-pressure selection valve 112*a*, an LS control valve 112*b*, an LS control piston 112*c*, torque control (power control) pistons 112*d* and 112*e* (first torque control actuators), and a spring 112*u*. The low-pressure selection valve 112*a* selects a pressure on the low pressure side from the LS differential pressure Pls1 outputted by the differential pressure reducing valve 111 and the LS differential pressure Pls2 outputted by the differential pressure reducing valve 211. The LS control valve 112*b* is supplied with the selected lower LS differential pressure Pls12 and the output pressure Pgr of the prime mover revolution speed detection valve 13 as the target LS differential pressure Pgr and changes load sensing drive pressure (hereinafter referred to as "LS drive pressure Px12") such that the LS drive pressure Px12 decreases as the LS differential pressure Pls12 decreases below the target LS differential pressure Pgr. The LS control piston 112*c* is supplied with the LS drive pressure Px12 and controls the tilting angle (displacement) of the main pump 102 so as to increase the tilting angle and thereby increase the delivery flow rate of the main pump 102 as the LS drive pressure Px12 decreases. The torque control (power control) piston 112*d* (first torque control actuator) is supplied with the pressure in the first delivery port 102*a* of the main pump 102 and controls the tilting angle of the swash plate of the main pump 102 so as to decrease the tilting angle and thereby decrease the absorption torque of the main pump 102 when the pressure in the first delivery port 102*a* increases. The torque control (power control) piston 112*e* (first torque control actuator) is supplied with the pressure in the second delivery port 102*b* of the main pump 102 and controls the tilting angle of the swash plate of the main pump 102 so as to decrease the tilting angle and thereby decrease the absorption torque of the main pump 102 when the pressure in the second delivery port 102*b* increases. The spring 112*u* is used as first biasing means for setting maximum torque T12*max* (see FIG. 3A).

The low-pressure selection valve 112*a*, the LS control valve 112*b* and the LS control piston 112*c* constitute a first load sensing control section which controls the displacement of the main pump 102 such that the delivery pressure of the main pump 102 (delivery pressure on the high pressure side of the first and second delivery ports 102*a* and 102*b*) becomes higher by a target differential pressure (target LS differential pressure Pgr) than the maximum load pressure of the actuators driven by the hydraulic fluid delivered from the main pump 102 (pressure on the high pressure side of the maximum load pressures Plmax1 and Plmax2).

The torque control pistons 112*d* and 112*e* and the spring 112*u* constitute a first torque control section which controls the displacement of the main pump 102 such that the absorption torque of the main pump 102 does not exceed the maximum torque T12*max* set by the spring 112*u* when the absorption torque of the main pump 102 increases due to an increase in at least one of the displacement of the main pump 102 and the delivery pressure of each delivery port 102*a*, 102*b* of the main pump 102 (the delivery pressure of main pump 102).

Figure 3A:
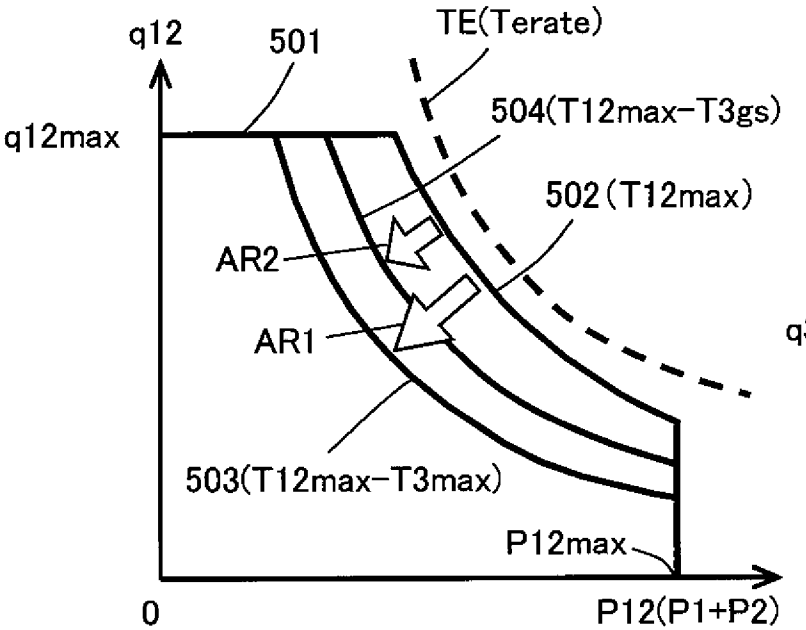
FIG. 3A is a diagram showing a torque control characteristic achieved by a first torque control section and an effect of this embodiment.

FIG. 3A is a diagram showing a torque control characteristic achieved by the first torque control section (the torque control pistons 112*d* and 112*e* and the spring 112*u*) and an effect of this embodiment. In FIG. 3A, P12 represents the sum P1+P2 of the pressures P1 and P2 in the first and second delivery ports 102*a* and 102*b* of the main pump 102

(the delivery pressure of the main pump 102), q12 represents the tilting angle of the swash plate of the main pump 102 (the displacement of the main pump 102), P12*max* represents the sum of the maximum delivery pressures of the first and second delivery ports 102*a* and 102*b* of the main pump 102 achieved by the set pressures of the main relief valves 114 and 214, and q12*max* represents a maximum tilting angle determined by the structure of the main pump 102. Incidentally, the absorption torque of the main pump 102 is represented by the product of the delivery pressure P12 (=P1+P2) and the tilting angle q12 of the main pump 102.

In FIG. 3A, the maximum absorption torque of the main pump 102 has been set by the spring 112*u* at T12*max* (maximum torque) indicated by the curve 502. When an actuator is driven by the hydraulic fluid delivered from the main pump 102 and the increasing absorption torque of the main pump 102 reaches the maximum torque T12*max*, the tilting angle of the main pump 102 is limited by the torque control pistons 112*d* and 112*e* of the regulator 112 such that the absorption torque of the main pump 102 does not increase further. For example, when the delivery pressure of the main pump 102 increases in a state in which the tilting angle of the main pump 102 is at a certain point on the curve 502, the torque control pistons 112*d* and 112*e* decrease the tilting angle q12 of the main pump 102 along the curve 502. When the tilting angle q12 of the main pump 102 begins to increase in a state in which the tilting angle of the main pump 102 is at a certain point on the curve 502, the torque control pistons 112*d* and 112*e* limit the tilting angle q12 of the main pump 102 such that the tilting angle q12 is maintained at a tilting angle on the curve 502. The reference character TE in FIG. 3A indicates a curve representing rated output torque Terate of the prime mover 1. The maximum torque T12*max* has been set at a value smaller than Terate. By setting the maximum torque T12*max* and limiting the absorption torque of the main pump 102 so as not to exceed the maximum torque T12*max* as above, the stoppage of the prime mover 1 (engine stall) when the main pump 102 drives an actuator can be prevented while utilizing the rated output torque Terate of the prime mover 1 as efficiently as possible.

The first load sensing control section (the low-pressure selection valve 112*a*, the LS control valve 112*b* and the LS control piston 112*c*) functions when the absorption torque of the main pump 102 is lower than the maximum torque T12*max* and is not undergoing the limitation by the torque control by the first torque control section, and controls the displacement of the main pump 102 by means of the load sensing control.

The regulator 212 (second pump control unit) includes an LS control valve 212*b*, an LS control piston 212*c* (load sensing control actuator), a torque control (power control) piston 212*d* (second torque control actuator), and a spring 212*e*. The LS control valve 212*b* is supplied with the LS differential pressure Pls3 outputted by the differential pressure reducing valve 311 and the output pressure Pgr of the prime mover revolution speed detection valve 13 as the target LS differential pressure Pgr and changes load sensing drive pressure (hereinafter referred to as "LS drive pressure Px3") such that the LS drive pressure Px3 decreases as the LS differential pressure Pls3 decreases below the target LS differential pressure Pgr. The LS control piston 212*c* (load sensing control actuator) is supplied with the LS drive pressure Px3 and controls the tilting angle (displacement) of the main pump 202 so as to increase the tilting angle and thereby increase the delivery flow rate of the main pump 202 as the LS drive pressure Px3 decreases. The torque control (power control) piston 212*d* (second torque control actuator) is supplied with the delivery pressure P3 of the main pump 202 and controls the tilting angle of the swash plate of the main pump 202 so as to decrease the tilting angle and thereby decrease the absorption torque of the main pump 202 when the delivery pressure P3 of the main pump 202 increases. The spring 212*e* is used as second biasing means for setting maximum torque T3*max* (see FIG. 3B).

The LS control valve 212*b* and the LS control piston 212*c* constitute a second load sensing control section which controls the displacement of the main pump 202 such that the delivery pressure P3 of the main pump 202 becomes higher by the target differential pressure (target LS differential pressure Pgr) than the maximum load pressure Plmax3 of the actuators driven by the hydraulic fluid delivered from the main pump 202.

The torque control piston 212*d* and the spring 212*e* constitute a second torque control section which controls the displacement of the main pump 202 such that the absorption torque of the main pump 202 does not exceed the maximum torque T3*max* when the absorption torque of the main pump 202 increases due to an increase in at least one of the delivery pressure P3 and the displacement of the main pump 202.

Figure 3B:
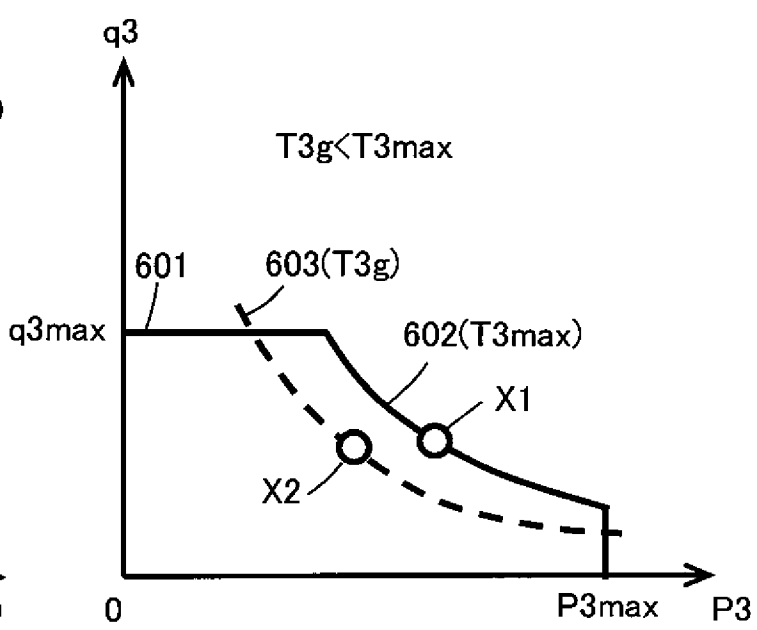
FIG. 3B is a diagram showing a torque control characteristic achieved by a second torque control section and an effect of this embodiment.

FIG. 3B is a diagram showing a torque control characteristic achieved by the second torque control section (the torque control piston 212*d* and the spring 212*e*) and an effect of this embodiment. In FIG. 3B, P3 represents the delivery pressure of the main pump 202, q3 represents the tilting angle of the swash plate of the main pump 202 (the displacement of the main pump 202), P3*max* represents the maximum delivery pressure of the main pump 202 achieved by the set pressure of the main relief valve 314, and q3*max* represents a maximum tilting angle determined by the structure of the main pump 202. Incidentally, the absorption torque of the main pump 202 is represented by the product of the delivery pressure P3 and the tilting angle q3 of the main pump 202.

In FIG. 3B, the maximum absorption torque of the main pump 202 has been set by the spring 212*e* at T3*max* (maximum torque) indicated by the curve 602. When an actuator is driven by the hydraulic fluid delivered from the main pump 202 and the increasing absorption torque of the main pump 202 reaches the maximum torque T3*max*, similarly to the case of the regulator 112 shown in FIG. 3A, the tilting angle of the main pump 202 is limited by the torque control piston 212*d* of the regulator 212 such that the absorption torque of the main pump 202 does not increase further.

The second load sensing control section (the LS control valve 212*b* and the LS control piston 212*c*) functions when the absorption torque of the main pump 202 is lower than the maximum torque T3*max* and is not undergoing the limitation by the torque control by the second torque control section, and controls the displacement of the main pump 202 by means of the load sensing control.

Returning to FIG. 1, the regulator 112 (first pump control unit) further includes a torque feedback circuit 112*v* and a torque feedback piston 112*f* (third torque control actuator). The torque feedback circuit 112*v* is supplied with the delivery pressure P3 of the main pump 202 and the LS drive pressure Px3 of the regulator 212, modifies the delivery pressure P3 of the main pump 202 to achieve a characteristic simulating the absorption torque of the main pump 202, and outputs the modified pressure. The torque feedback piston 112*f* (third torque control actuator) is supplied with the output pressure of the torque feedback circuit 112*v* and controls the tilting angle of the swash plate of the main pump 102 (the displacement of the main pump 102) so as to decrease the tilting angle of the main pump 102 and decrease the maximum torque T12*max* set by the spring 112*u* as the output pressure of the torque feedback circuit 112*v* increases. The torque feedback circuit 112*v* is configured to correct the delivery pressure P3 of the main pump 202 to achieve a characteristic simulating the absorption torque of the main pump 202 in both of when the main pump 202 (second hydraulic pump) undergoes the limitation by the torque control and operates at the maximum torque T3*max* of the torque control and when the main pump 202 does not undergo the limitation by the torque control and performs the displacement control by means of the load sensing control, and output the modified pressure (explained later).

In FIG. 3A, the arrows AR1 and AR2 indicate the effects of the torque feedback circuit 112*v* and the torque feedback piston 112*f*. When the delivery pressure P3 of the main pump 202 increases, the torque feedback circuit 112*v* modifies the delivery pressure P3 to achieve a characteristic simulating the absorption torque of the main pump 202 and outputs the modified pressure, and the torque feedback piston 112*f* decreases the maximum torque T12*max* set by the spring 112*u* by an amount corresponding to the output pressure of the torque feedback circuit 112*v* as indicated by the arrows AR1 and AR2 in FIG. 3A. Accordingly, even in the combined operation in which an actuator related to the main pump 102 and an actuator related to the main pump 202 are driven at the same time, the absorption torque of the main pump 102 is controlled not to exceed the maximum torque T12*max* (total torque control) and the stoppage of the prime mover 1 (engine stall) can be prevented. Incidentally, the arrow AR1 in FIG. 3A indicates the case where the main pump 202 (second hydraulic pump) undergoes the limitation by the torque control and operates at the maximum torque T3*max* of the torque control, while the arrow AR2 in FIG. 3A indicates the case where the main pump 202 does not undergo the limitation by the torque control and performs the displacement control by means of the load sensing control (explained later).

Details of Torque Feedback Circuit

The details of the torque feedback circuit 112*v* will be explained below.

Circuit Structure

The torque feedback circuit 112*v* includes a first variable pressure reducing valve 112*g* and a second variable pressure reducing valve 112*q*.

The delivery pressure P3 of the main pump 202 is led to the input port of the first variable pressure reducing valve 112*g* via a hydraulic line 112*j*. The first variable pressure reducing valve 112*g* outputs the delivery pressure P3 of the main pump 202 without change when the delivery pressure P3 of the main pump 202 is lower than or equal to a first set pressure. When the delivery pressure P3 of the main pump 202 is higher than the first set pressure, the first variable pressure reducing valve 112*g* reduces the delivery pressure P3 of the main pump 202 to the first set pressure and outputs the reduced pressure. The LS drive pressure Px3 of the regulator 212 is led to the input port of the second variable pressure reducing valve 112*q* via a hydraulic line 112*k*. The second variable pressure reducing valve 112*q* outputs the LS drive pressure Px3 without change when the LS drive pressure Px3 is lower than or equal to a second set pressure. When the LS drive pressure Px3 is higher than the second set pressure, the second variable pressure reducing valve 112*q* reduces the LS drive pressure Px3 to the second set pressure and outputs the reduced pressure.

The first variable pressure reducing valve 112*g* has a spring 112*t* working in an opening direction and setting the initial value of the first set pressure and a pressure receiving part 112*h* situated on a side of the valve 112*g* opposite to the spring 112*t*. The pressure receiving part 112*h* is supplied with the output pressure of the second variable pressure reducing valve 112*q* via a hydraulic line 112*n*. The first variable pressure reducing valve 112*g* is configured such that the first set pressure decreases as the output pressure of the second variable pressure reducing valve 112*q* increases. The second variable pressure reducing valve 112*q* has a spring 112*s* working in an opening direction and setting the initial value of the second set pressure and a pressure receiving part 112*i* situated on a side of the valve 112*q* opposite to the spring 112*s*. The pressure receiving part 112*i* is supplied with the delivery pressure P3 of the main pump 202 via the hydraulic line 112*j*. The second variable pressure reducing valve 112*q* is configured such that the second set pressure decreases as the delivery pressure P3 of the main pump 202 increases.

The output pressure of the first variable pressure reducing valve 112*g* is led to the torque feedback piston 112*f* as the output pressure of the torque feedback circuit 112*v*.

The hydraulic line 112*k* for leading the LS drive pressure Px3 to the input port of the second variable pressure reducing valve 112*q* is equipped with a restrictor (fixed restrictor) 112*r* for absorbing vibration of the LS drive pressure Px3 and stabilizing the pressure when the LS drive pressure Px3 is vibrational.

Output Characteristic of Circuit

Second Variable Pressure Reducing Valve 112*q*

Figure 4:
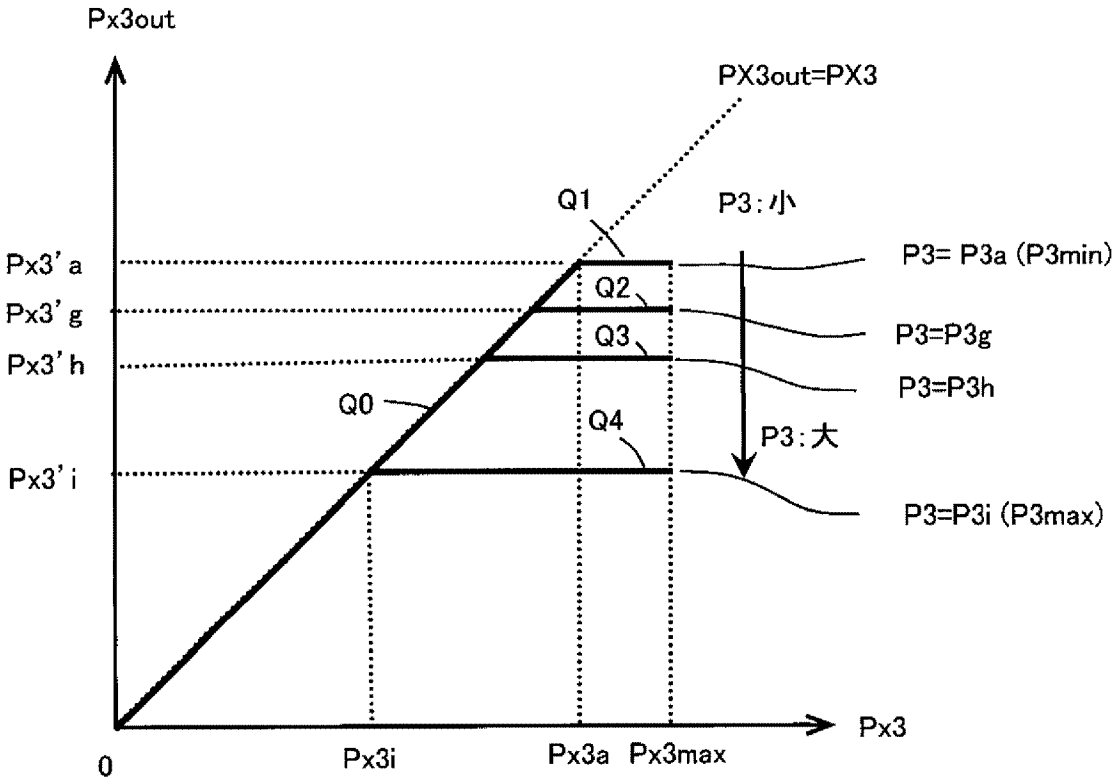
FIG. 4 is a diagram showing the output characteristic of a second variable pressure reducing valve of a torque feedback circuit.

FIG. 4 is a diagram showing the output characteristic of the second variable pressure reducing valve 112*q* of the torque feedback circuit 112*v*.

The LS drive pressure Px3 is led to the input port of the second variable pressure reducing valve 112*q* via the restrictor 112*r*.

Meanwhile, the delivery pressure P3 of the main pump 202 is led to the pressure receiving part 112*i* on the side of the second variable pressure reducing valve 112*q* opposite to the spring 112*s* for setting the initial value of the second set pressure of the second variable pressure reducing valve 112*q*. When the delivery pressure P3 of the main pump 202 is at a minimum pressure P3*min*, the second set pressure of the second variable pressure reducing valve 112*q* is set at the pressure determined by the spring 112*s* (initial value). The second set pressure of the second variable pressure reducing valve 112*q* decreases as the delivery pressure P3 of the main pump 202 increases. Therefore, the LS drive pressure Px3 inputted to the second variable pressure reducing valve 112*q* changes depending on the delivery pressure P3 of the main pump 202, and the output pressure of the second variable pressure reducing valve 112*q* displays the characteristic shown in FIG. 4.

In FIG. 4, the reference characters Q1-Q4 represent the pressure reducing characteristic of the second variable pressure reducing valve 112*q* which changes depending on the delivery pressure P3 of the main pump 202. The reference character Q1 represents the characteristic when the delivery pressure P3 of the main pump 202 is at the minimum pressure P3*min*, and Px3'*a* represents the second set pressure at that time (the initial value set by the spring 112*s*). The reference character Q4 represents the characteristic when the delivery pressure P3 of the main pump 202 is at the maximum pressure P3*max*, and Px3'*i* represents the second set pressure at that time (minimum second set pressure). As the delivery pressure P3 of the main pump 202 increases like P3*a* (P3*min*), P3*g*, P3*h* and P3*i* (P3*max*), the second set pressure of the second variable pressure reducing valve 112*q* decreases like Px3'*a*, Px3'*g*, Px3'*h* and Px3'*i*, and the pressure reducing characteristic of the second variable pressure reducing valve 112*q* changes like the straight lines Q1, Q2, Q3 and Q4. Consequently, when the LS drive pressure Px3 is higher than the second set pressure of the second variable pressure reducing valve 112*q*, the output pressure Px3*out* of the second variable pressure reducing valve 112*q* decreases like Px3'*a*, Px3'*g*, Px3'*h* and Px3'*i* as the delivery pressure P3 of the main pump 202 increases.

When the LS drive pressure Px3 is lower than or equal to the second set pressure of the second variable pressure reducing valve 112*q*, the LS drive pressure Px3 is directly outputted without being reduced. The straight line Q0 indicates the characteristic in this case.

First Variable Pressure Reducing Valve 112*g*

Figure 5:
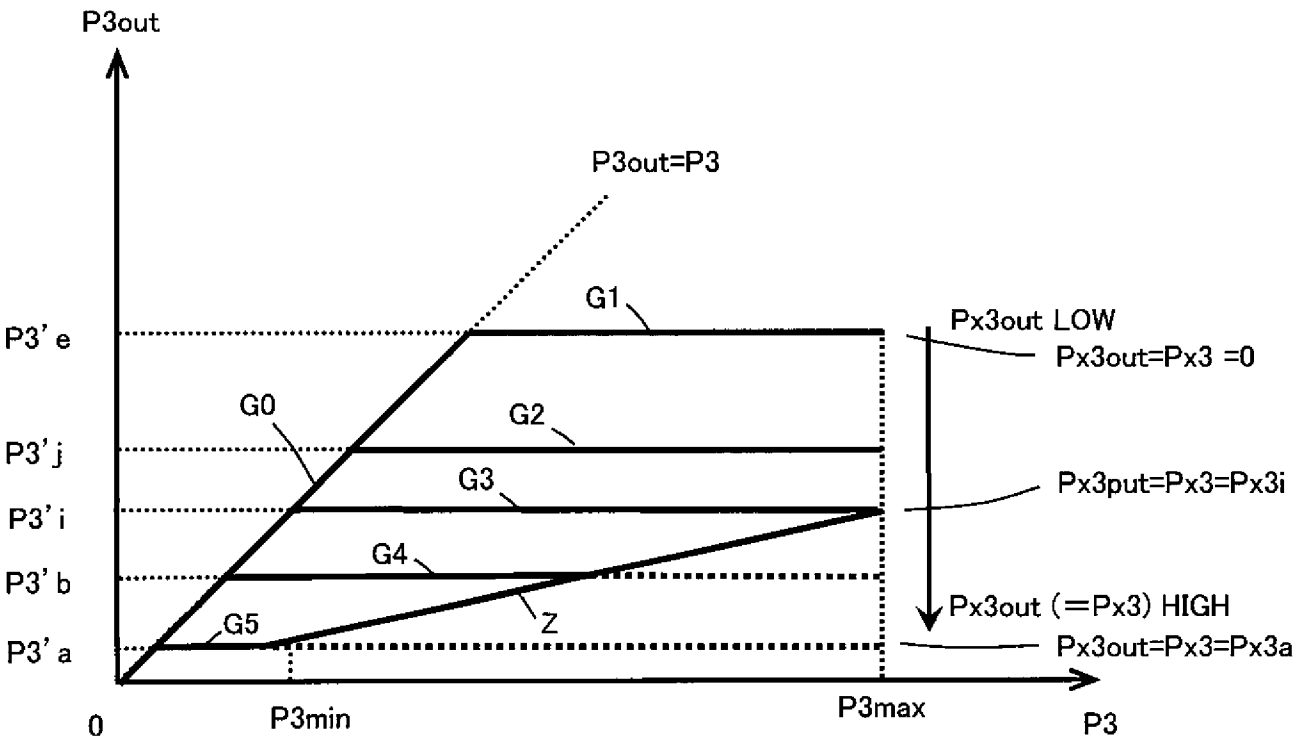
FIG. 5 is a diagram showing the output characteristic of a first variable pressure reducing valve of the torque feedback circuit.

FIG. 5 is a diagram showing the output characteristic of the first variable pressure reducing valve 112*g* of the torque feedback circuit 112*v*.

The delivery pressure P3 of the main pump 202 is led to the input port of the first variable pressure reducing valve 112*g*.

Meanwhile, the output pressure P3*out* of the second variable pressure reducing valve 112*q* is led to the pressure receiving part 112*h* on the side of the first variable pressure reducing valve 112*g* opposite to the spring 112*t* for setting the initial value of the first set pressure of the first variable pressure reducing valve 112*g*. When the output pressure P3*out* of the second variable pressure reducing valve 112*q* is at the tank pressure as the minimum pressure, the first set pressure of the first variable pressure reducing valve 112*g* is set at the pressure determined by the spring 112*t* (initial value). The first set pressure of the first variable pressure reducing valve 112*g* decreases as the output pressure P3*out* of the second variable pressure reducing valve 112*q* increases (first pressure reducing characteristic). Meanwhile, as mentioned above, the output pressure P3*out* of the second variable pressure reducing valve 112*q* changes depending on the delivery pressure P3 of the main pump 202, and the first set pressure of the first variable pressure reducing valve 112*g* also changes depending on the delivery pressure P3 of the main pump 202 (second pressure reducing characteristic). As above, the first set pressure of the first variable pressure reducing valve 112*g* changes depending on the LS drive pressure Px3 and the delivery pressure P3 of the main pump 202, and the output pressure of the first variable pressure reducing valve 112*g* displays the characteristic shown in FIG. 5.

In FIG. 5, the reference characters G1-G5 represent the first pressure reducing characteristic of the first variable pressure reducing valve 112*g* obtained when the LS drive pressure Px3 is lower than or equal to the second set pressure and is not reduced. The reference character Z represents the second pressure reducing characteristic obtained when the LS drive pressure Px3 is higher than the second set pressure and is reduced to the second set pressure. The reference character G1 represents the characteristic when the output pressure P3*out* of the second variable pressure reducing valve 112*q* is at the tank pressure as the minimum pressure, and P3'*e* represents the first set pressure at that time (the initial value set by the spring 112*t*). The reference character G3 represents the characteristic when the output pressure P3*out* of the second variable pressure reducing valve 112*q* is Px3*i* (see FIG. 4). The reference character G5 represents the characteristic when the output pressure P3*out* of the second variable pressure reducing valve 112*q* is Px3*a* (see FIG. 4).

When the LS drive pressure Px3 is lower than or equal to the second set pressure and is not reduced in the second variable pressure reducing valve 112*q*, as the LS drive pressure Px3 increases, the second set pressure of the first variable pressure reducing valve 112*g* decreases like P3'*e*, P3'*j*, P3'*i*, P3'*b* and P3'*a* and the first pressure reducing characteristic of the first variable pressure reducing valve 112*g* changes like the straight lines G1, G2, G3, G4 and G5. Consequently, the output pressure P3*out* of the first variable pressure reducing valve 112*g* in the case where the delivery pressure P3 of the main pump 202 is higher than the second set pressure of the first variable pressure reducing valve 112*g* decreases like P3'*e*, P3'*jc*, P3'*i*, P3'*b* and P3'*a* as the LS drive pressure Px3 increases.

When the LS drive pressure Px3 is higher than the second set pressure and is reduced to the second set pressure in the second variable pressure reducing valve 112*q*, the output pressure Px3*out* of the second variable pressure reducing valve 112*q* decreases like Px3'*a*, Px3'*g*, Px3'*h* and Px3'*i* as the delivery pressure P3 of the main pump 202 increases as shown in FIG. 4. Since the second set pressure of the first variable pressure reducing valve 112*g* increases as the output pressure Px3*out* decreases, the second pressure reducing characteristic of the first variable pressure reducing valve 112*g* changes like the straight line Z. Consequently, the output pressure P3*out* of the first variable pressure reducing valve 112*g* in the case where the delivery pressure P3 of the main pump 202 is higher than the second set pressure of the first variable pressure reducing valve 112*g* increases linearly and proportionally like the straight line Z as the delivery pressure P3 of the main pump 202 increases.

When the delivery pressure P3 of the main pump 202 is lower than or equal to the second set pressure of the first variable pressure reducing valve 112*g*, the delivery pressure P3 of the main pump 202 is directly outputted without being reduced. The straight line G0 indicates the characteristic in this case.

Simulation of Absorption Torque

Next, an explanation will be given of the function of the torque feedback circuit 112*v* correcting the delivery pressure P3 of the main pump 202 to achieve a characteristic simulating the absorption torque of the main pump 202 and outputting the modified pressure.

When the main pump 202 performs the displacement control by means of the load sensing control, the position of the displacement changing member (swash plate) of the main pump 202, that is, the displacement (tilting angle) of the main pump 202, is determined by the equilibrium between resultant force of two pushing forces applied to the swash plate from the LS control piston 212*c* on which the LS drive pressure acts and from the torque control piston 212*d* on which the delivery pressure P3 of the main pump 202 acts and pushing force applied to the swash plate in the opposite direction from the spring 212*e* serving as the biasing means for setting the maximum torque. Therefore, the tilting angle of the main pump 202 during the load sensing control changes not only depending on the LS drive pressure but also due to the influence of the delivery pressure P3 of the main pump 202.

Figure 6A:
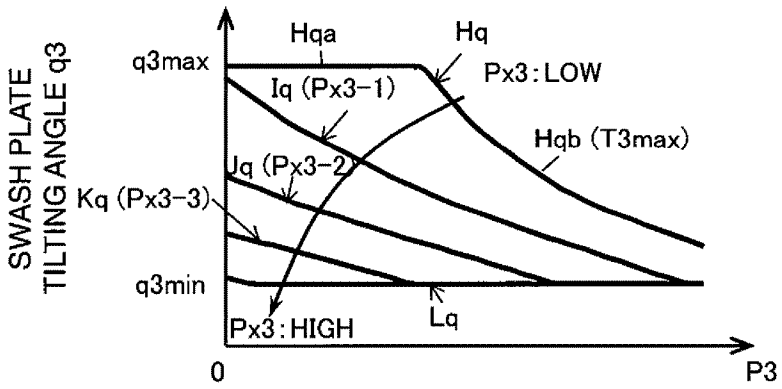
FIG. 6A is a diagram showing the relationship between torque control and load sensing control in a regulator (second pump control unit) of a main pump (second hydraulic pump).
Figure 6B:
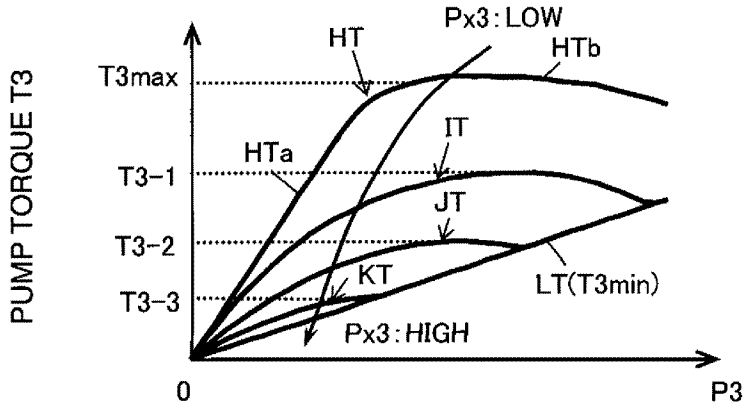
FIG. 6B is a diagram showing the relationship between the torque control and the load sensing control by replacing the vertical axis of FIG. 6A with absorption torque of the main pump.

FIG. 6A is a diagram showing the relationship between the torque control and the load sensing control in the regulator 212 of the main pump 202 (relationship among the delivery pressure P3, the tilting angle and the LS drive pressure Px3 of the main pump 202). FIG. 6B is a diagram showing the relationship between the torque control and the load sensing control by replacing the vertical axis of FIG. 6A with the absorption torque of the main pump 202

(relationship among the delivery pressure P3, the absorption torque and the LS drive pressure Px3 of the main pump 202).

When any one of the control levers of the actuators 3*a*, 3*e* and 3*h* related to the main pump 202 is operated by the full operation and the delivery flow rate of the main pump 202 saturates and the LS drive pressure Px3 becomes equal to the tank pressure (e.g., boom raising full operation (c) which will be explained later), as the delivery pressure P3 of the main pump 202 increases, the tilting angle q3 of the main pump 202 changes like the characteristic Hq (Hqa, Hqb) shown in FIG. 6A, and the absorption torque T3 of the main pump 202, which is proportional to the product of the delivery pressure P3 and the tilting angle q3 of the main pump 202, changes like the characteristic HT (Hta, HTb) shown in FIG. 6B. The straight line Hqa in the characteristic Hq corresponds to the straight line 601 in FIG. 3B and indicates the characteristic of the maximum tilting angle q3*max* determined by the structure of the main pump 202. The curve Hqb in the characteristic Hq corresponds to the curve 602 in FIG. 3B and indicates the characteristic of the maximum torque T3*max* set by the spring 212*e*. Before the absorption torque T3 of the main pump 202 reaches T3*max*, the tilting angle q3 is constant at q3*max* as indicated by the straight line Hqa (FIG. 6A). In this case, the absorption torque T3 of the main pump 202 increases almost linearly as the delivery pressure P3 increases as indicated by the straight line Hta (FIG. 6B). After the absorption torque T3 reaches T3*max*, the tilting angle q3 decreases as the delivery pressure P3 increases as indicated by the straight line Hqb (FIG. 6A). In this case, the absorption torque T3 of the main pump 202 remains almost constant at T3*max* as indicated by the curve Htb (FIG. 6B).

When any one of the control levers of the actuators 3*a*, 3*e* and 3*h* related to the main pump 202 is operated by a fine operation and the LS drive pressure Px3 increases to an intermediate pressure between the tank pressure and the pilot primary pressure Ppilot (e.g., boom raising fine operation (b) and horizontally leveling work (f) which will be explained later), as the LS drive pressure Px3 increases like Px3-1, Px3-2 and Px3-3, the tilting angle q3 of the main pump 202 changes like the curves Iq, Jq and Kq in FIG. 6A, and the absorption torque T3 of the main pump 202 changes correspondingly like the curves IT, JT and KT in FIG. 6B.

In other words, when the delivery pressure P3 of the main pump 202 rises, the tilting angle q3 of the main pump 202 decreases like the curve Iq due to the influence of the increase in the delivery pressure P3 as mentioned above even if the LS drive pressure Px3 is constant at Px3*b*, for example. Thus, in a high pressure range of the delivery pressure P3, the tilting angle q3 becomes smaller than the tilting angle situated on the curve Hqb of T3*max* (FIG. 6A). As a result, as the delivery pressure P3 increases, the absorption torque T3 of the main pump 202 increases like the curve IT, eventually reaches maximum torque T3-1 lower than T3*max*, and becomes almost constant (FIG. 6B). However, the tilting angle q3 does not decrease below a minimum tilting angle q3*min* determined by the structure of the main pump 202 and the absorption torque T3 also does not decrease below minimum torque T3*min* of the straight line LT corresponding to the minimum tilting angle q3*min*.

The same goes for the cases where the LS drive pressure Px3 is Px3-2 or Px3-3. The tilting angle q3 decreases like the curves Jq and Kq due to the influence of the increase in the delivery pressure P3, and becomes even smaller than the tilting angle on the curve Iq in a high pressure range of the delivery pressure P3 (FIG. 6A). Correspondingly, as the delivery pressure P3 increases, the absorption torque T3 of the main pump 202 increases like the curve JT or KT, eventually reaches maximum torque at T3-2 or T3-3 even lower than T3-1 (i.e., T3-1>T3-2>T3-3), and becomes almost constant (FIG. 6B). However, also in these cases, the tilting angle q3 does not decrease below the minimum tilting angle q3*min* determined by the structure of the main pump 202 and the absorption torque T3 also does not decrease below the minimum torque T3*min* of the straight line LT corresponding to the minimum tilting angle q3*min*.

When all the control levers of the actuators 3*a*, 3*e* and 3*h* related to the main pump 202 are at the neutral positions and when any one of these control levers is operated but its operation amount is extremely small and the demanded flow rate of the flow control valve is lower than a minimum flow rate obtained at the minimum tilting angle q3*min* of the main pump 202 (e.g., (a) operation when all control levers are at the neutral positions and (g) boom raising fine operation in load lifting work which will be explained later), the tilting angle q3 of the main pump 202 is maintained at the minimum tilting angle q3*min* determined by the structure of the main pump 202 as indicated by the straight line Lq in FIG. 6A. Correspondingly, the absorption torque T3 of the main pump 202 also becomes equal to the minimum torque T3*min*, and the minimum torque T3*min* changes like the straight line LT in FIG. 6B. In short, the minimum torque T3*min* increases linearly and proportionally like the straight line LT as the delivery pressure P3 increases.

Returning to FIG. 5, the maximum value of the output pressure P3*out* of the torque feedback circuit 112*v* at times of increase in the delivery pressure P3 of the main pump 202 decreases as the LS drive pressure Px3 increases as indicated by the straight lines G1-G5 of the first pressure reducing characteristic shown in FIG. 5. When the main pump 202 is at the minimum tilting angle q3*min*, the output pressure P3*out* of the torque feedback circuit 112*v* at times of increase in the delivery pressure P3 of the main pump 202 increases linearly and proportionally like the straight line Z of the second pressure reducing characteristic shown in FIG. 5.

As is clear from the comparison between FIG. 5 and FIG. 6B, the pressure of each straight line G1-G5 of the first pressure reducing characteristic shown in FIG. 5 (the maximum value of the output pressure P3*out*) changes so as to decrease as the LS drive pressure Px3 increases similarly to the maximum value of the absorption torque of each curve HT, IT, JT, KT shown in FIG. 6B. When the main pump 202 is at the minimum tilting angle q3*min*, the pressure of the straight line Z of the second pressure reducing characteristic shown in FIG. 5 increases linearly and proportionally as the delivery pressure P3 increases similarly to the curve LT shown in FIG. 6B.

As explained above, the torque feedback circuit 112*v* modifies the delivery pressure P3 of the main pump 202 to achieve a characteristic simulating the absorption torque of the main pump 202 in both of when the main pump 202 (second hydraulic pump) undergoes the limitation by the torque control and operates at the maximum torque T3*max* of the torque control and when the main pump 202 does not undergo the limitation by the torque control and performs the displacement control by means of the load sensing control, and outputs the modified pressure. Also when the main pump 202 is at the minimum tilting angle q3*min*, the torque feedback circuit 112*v* modifies the delivery pressure P3 of the main pump 202 to achieve a characteristic simulating the absorption torque of the main pump 202 and outputs the modified pressure.

Hydraulic Excavator

FIG. 7 is a schematic diagram showing the external appearance of the hydraulic excavator in which the hydraulic drive system explained above is installed.

Referring to FIG. 7, the hydraulic excavator, which is well known as an example of a work machine, includes a lower track structure 101, an upper swing structure 109, and a front work implement 104 of the swinging type. The front work implement 104 is made up of a boom 104*a*, an arm 104*b* and a bucket 104*c*. The upper swing structure 109 can be swung by a swing motor 3*c* with respect to the lower track structure 101. A swing post 103 is attached to the front of the upper swing structure 109. The front work implement 104 is attached to the swing post 103 to be movable vertically. The swing post 103 can be swung horizontally with respect to the upper swing structure 109 by the expansion and contraction of the swing cylinder 3*e*. The boom 104*a*, the arm 104*b* and the bucket 104*c* of the front work implement 104 can be rotated vertically by the expansion and contraction of the boom cylinder 3*a*, the arm cylinder 3*b* and the bucket cylinder 3*d*, respectively. A blade 106 which is moved vertically by the expansion and contraction of the blade cylinder 3*h* (see FIG. 1) is attached to a center frame of the lower track structure 101. The lower track structure 101 carries out the traveling of the hydraulic excavator by driving left and right crawlers 101*a* and 101*b* (only the left side is shown in FIG. 7) with the rotation of the travel motors 3*f* and 3*g*.

The upper swing structure 109 is provided with a cab 108 of the canopy type. Arranged in the cab 108 are a cab seat 121, left and right front/swing operating devices 122 and 123 (only the left side is shown in FIG. 7), travel operating devices 124*a* and 124*b* (only the left side is shown in FIG. 7), an unshown swing operating device, an unshown blade operating device, the gate lock lever 24, and so forth. The control lever of each of the operating devices 122 and 123 can be operated in any direction with reference to the cross-hair directions from its neutral position. When the control lever of the left operating device 122 is operated in the longitudinal direction, the operating device 122 functions as an operating device for the swinging. When the control lever of the left operating device 122 is operated in the transverse direction, the operating device 122 functions as an operating device for the arm. When the control lever of the right operating device 123 is operated in the longitudinal direction, the operating device 123 functions as an operating device for the boom. When the control lever of the right operating device 123 is operated in the transverse direction, the operating device 123 functions as an operating device for the bucket.

Operation

Next, the operation of this embodiment will be explained below.

First, the hydraulic fluid delivered from the fixed displacement pilot pump 30 driven by the prime mover 1 is supplied to the hydraulic fluid supply line 31*a*. The hydraulic fluid supply line 31*a* is equipped with the prime mover revolution speed detection valve 13. By using the flow rate detection valve 50 and the differential pressure reducing valve 51, the prime mover revolution speed detection valve 13 outputs the differential pressure across the flow rate detection valve 50 corresponding to the delivery flow rate of the pilot pump 30 as the absolute pressure Pgr (target LS differential pressure). The pilot relief valve 32 connected downstream of the prime mover revolution speed detection valve 13 generates the constant pressure (the pilot primary pressure Ppilot) in the pilot hydraulic fluid supply line 31*b*.

(a) When All Control Levers are at Neutral Positions

All the flow control valves 6*a*-6*j* are positioned at their neutral positions since the control levers of all the operating devices are at their neutral positions. Since all the flow control valves 6*a*-6*j* are at the neutral positions, the first load pressure detection circuit 131, the second load pressure detection circuit 132 and the third load pressure detection circuit 133 detect the tank pressure as the maximum load pressures Plmax1, Plmax2 and Plmax3, respectively. These maximum load pressures Plmax1, Plmax2 and Plmax3 are led to the unloading valves 115, 215 and 315 and the differential pressure reducing valves 111, 211 and 311, respectively.

Due to the maximum load pressure Plmax1, Plmax2, Plmax3 led to each unloading valve 115, 215, 315, the pressure P1, P2, P3 in each of the first, second and third delivery ports 102*a*, 102*b* and 202*a* is maintained at a minimum pressure P1*min*, P2*min*, P3*min* as a pressure (unloading valve set pressure) obtained as the sum of the maximum load pressure Plmax1, Plmax2, Plmax3 and the set pressure of the spring of each unloading valve 115, 215, 315. Assuming that the set pressure of the spring of each unloading valve 115, 215, 315 equals Punsp, the set pressure Punsp is generally set at a value slightly higher than the output pressure Pgr of the prime mover revolution speed detection valve 13 defined as the target LS differential pressure (Punsp>Pgr).

Each differential pressure reducing valve 111, 211, 311 outputs the differential pressure (LS differential pressure) between the pressure P1, P2, P3 in each of the first, second and third hydraulic fluid supply lines 105, 205 and 305 and the maximum load pressure Plmax1, Plmax2, Plmax3 (tank pressure) as the absolute pressure Pls1, Pls2, Pls3. The maximum load pressures Plmax1, Plmax2 and Plmax3 equal the tank pressure as mentioned above. Assuming that the tank pressure is Ptank, the following relationships hold:

$$Pls1=P1-Plmax1=(Ptank+Punsp)-Ptank=Punsp>Pgr$$

$$Pls2=P2-Plmax2=(Ptank+Punsp)-Ptank=Punsp>Pgr$$

$$Pls3=P3-Plmax3=(Ptank+Punsp)-Ptank=Punsp>Pgr$$

The LS differential pressures Pls1 and Pls2 are led to the low-pressure selection valve 112*a* of the regulator 112, while the LS differential pressure Pls3 is led to the LS control valve 212*b* of the regulator 212.

In the regulator 112, the low pressure side is selected from the LS differential pressures Pls1 and Pls2 led to the low-pressure selection valve 112*a* and the selected lower pressure is led to the LS control valve 112*b* as the LS differential pressure Pls12. In this case, Pls12>Pgr holds irrespective of which of Pls1 or Pls2 is selected, and thus the LS control valve 112*b* is pushed leftward in FIG. 1 and switched to the right-hand position. The LS drive pressure Px12 rises to the constant pilot primary pressure Ppilot generated by the pilot relief valve 32, and the pilot primary pressure Ppilot is led to the LS control piston 112*c*. Since the pilot primary pressure Ppilot is led to the LS control piston 112*c*, the displacement (flow rate) of the main pump 102 is maintained at the minimum level.

Meanwhile, the LS differential pressure Pls3 is led to the LS control valve 212*b* of the regulator 212. Since Pls3>Pgr holds, the LS control valve 212*b* is pushed rightward in FIG. 1 and switched to the left-hand position. The LS drive pressure Px3 rises to the pilot primary pressure Ppilot, and the pilot primary pressure Ppilot is led to the LS control piston 212*c*. Since the pilot primary pressure Ppilot is led to the LS control piston 212*c*, the displacement (flow rate) of the main pump 202 is maintained at the minimum level.

(a-1) Operation of Torque Feedback Circuit 112*v*

Figure 8:
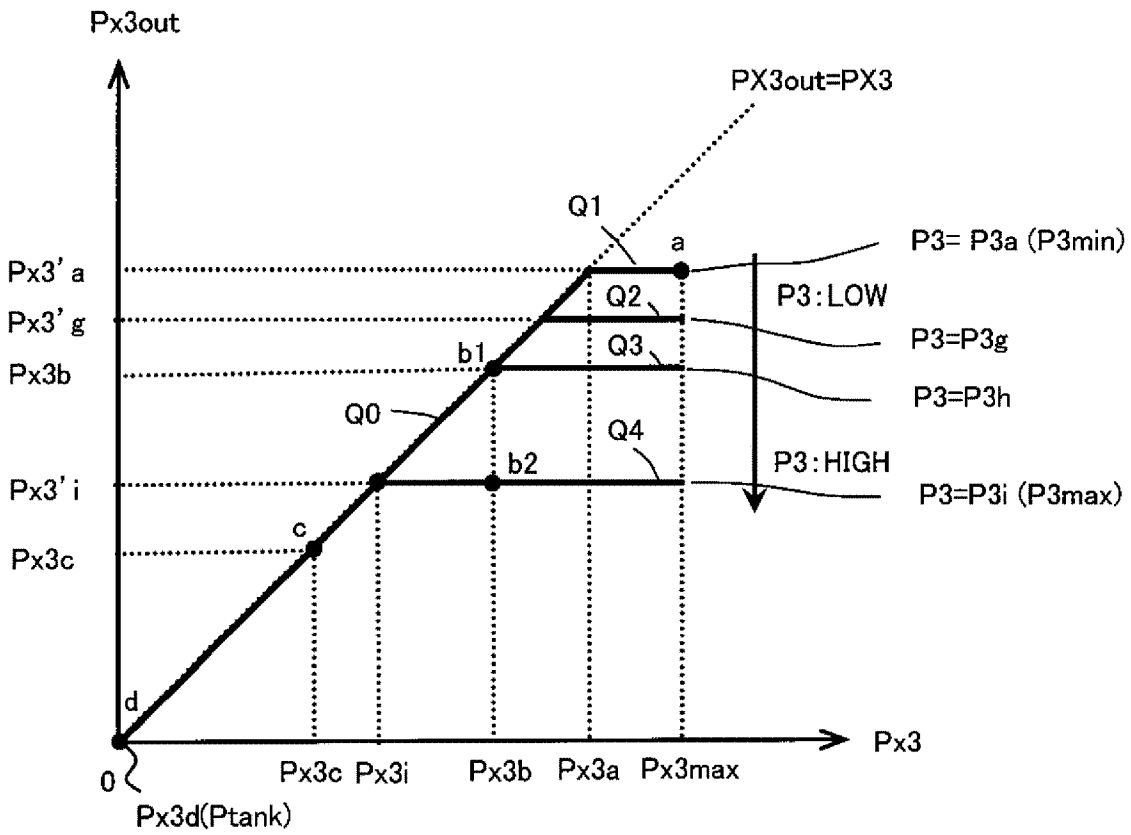
FIG. 8 is an operation diagram showing operating points of the second variable pressure reducing valve (filled circles) in addition to the output characteristic of the second variable pressure reducing valve shown in FIG. 4.
Figure 9:
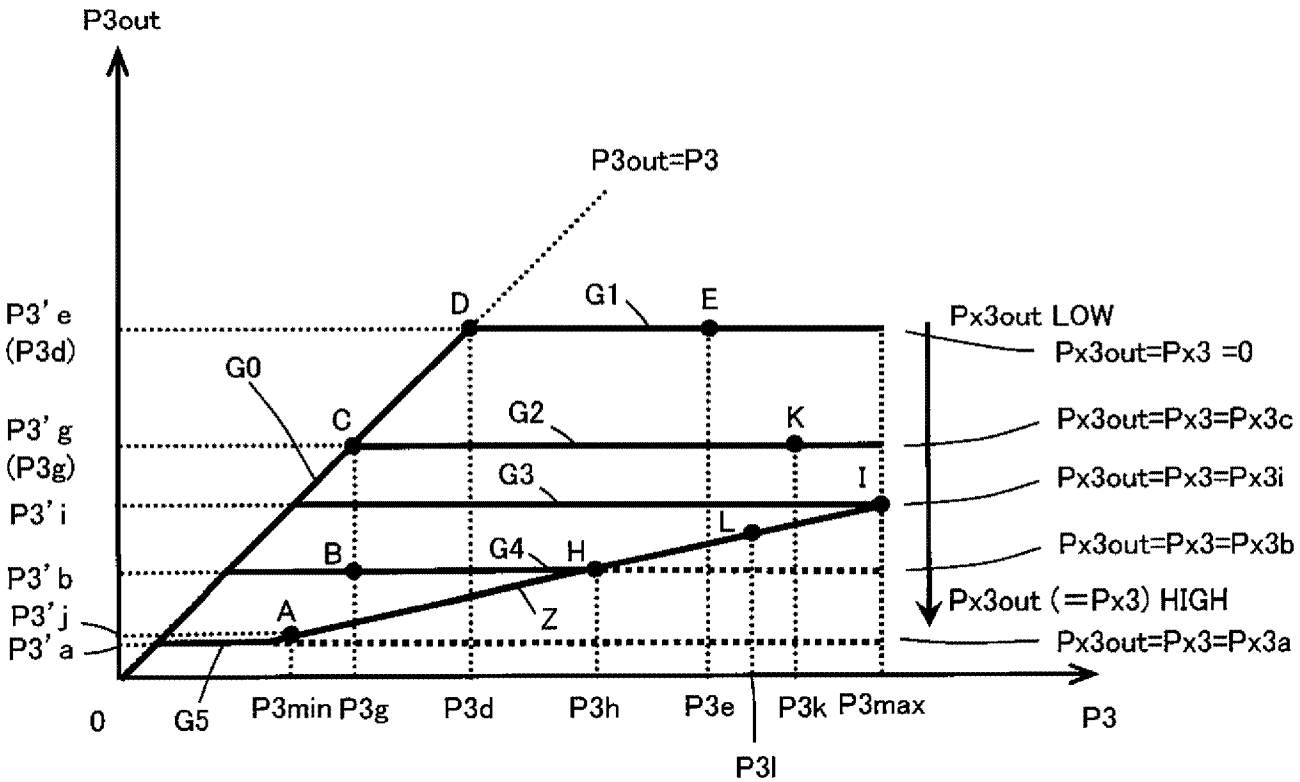
FIG. 9 is an operation diagram showing operating points of the first variable pressure reducing valve (filled circles) in addition to the output characteristic of the first variable pressure reducing valve shown in FIG. 5.

FIG. 8 is an operation diagram showing operating points of the second variable pressure reducing valve 112*q* (filled circles) in addition to the output characteristic of the second variable pressure reducing valve 112*q* shown in FIG. 4. FIG. 9 is an operation diagram showing operating points of the first variable pressure reducing valve 112*g* (filled circles) in addition to the output characteristic of the first variable pressure reducing valve 112*g* shown in FIG. 5.

When all the control levers are at the neutral positions, the delivery pressure P3 of the main pump 202 (pressure in the third hydraulic fluid supply line 305) is maintained at the minimum delivery pressure P3*min* as the sum of the tank pressure and the set pressure of the spring of the unloading valve 315 as mentioned above. The pressure is assumed to be P3*a*.

In the second variable pressure reducing valve 112*q*, the second set pressure decreases from the initial value due to the delivery pressure P3*a* of the main pump 202 at that time. Since P3*a*=P3*min* holds, the first variable pressure reducing valve 112*q* displays the characteristic indicated by the straight line Q1 in FIG. 8.

Meanwhile, the LS drive pressure Px3 led to the LS control piston 212*c* of the main pump 202 at that time has reached the constant pilot primary pressure Ppilot of the pilot hydraulic fluid supply line 31*b* (maximum) as mentioned above. This value is assumed to be Px3*max*. The LS drive pressure Px3*max* is led to the input port of the second variable pressure reducing valve 112*q* via the restrictor 112*r* and is reduced by the second variable pressure reducing valve 112*q* to the pressure Px3'*a* of the point a.

The pressure of the point a as the result of the pressure reduction to Px3'*a* is led to the pressure receiving part 112*h* of the first variable pressure reducing valve 112*g* as the output pressure Px3*out* of the second variable restrictor 112*q*. Since the pressure Px3'*a* is the reduced pressure, the first variable pressure reducing valve 112*g* displays the characteristic (second pressure reducing characteristic) indicated by the straight line Z in FIG. 9.

The delivery pressure P3*a* (P3*min*) of the main pump 202 led to the input port of the first variable pressure reducing valve 112*g* is reduced to P3'*j* by the pressure reducing characteristic of the first variable pressure reducing valve 112*g* indicated by the straight line Z. This state is represented by the point A in FIG. 9.

The pressure reduced to P3'*j* is led to the torque feedback piston 112*f* as the output pressure P3*out* of the first variable pressure reducing valve 112*g*. In the torque feedback piston 112*f*, force determined by the product of P3'*j* and the pressure receiving area of the torque feedback piston 112*f* works in a direction for reducing the displacement (tilting angle) of the main pump 102. However, the displacement (tilting angle) of the main pump 102 has already been maintained at the minimum level by the LS control piston 112*c* as mentioned above, and thus this state is maintained.

(b) When Boom Control Lever is Operated (Fine Operation)

When the control lever of the boom operating device (boom control lever) is operated in the direction of expanding the boom cylinder 3*a* (i.e., boom raising direction), for example, the flow control valves 6*a* and 6*i* for driving the boom cylinder 3*a* are switched upward in FIG. 1. As explained referring to FIG. 2B, the opening area characteristics of the flow control valves 6*a* and 6*i* for driving the boom cylinder 3*a* have been set so as to use the flow control valve 6*a* for the main driving and the flow control valve 6*i* for the assist driving. The flow control valves 6*a* and 6*i* stroke according to the operating pilot pressure outputted by the pilot valve of the operating device.

When the operation on the boom control lever is a fine operation and the strokes of the flow control valves 6*a* and 6*i* are within S2 shown in FIG. 2B, the opening area of the meter-in channel of the flow control valve 6*a* for the main driving increases gradually from zero to A1 as the operation amount (operating pilot pressure) of the boom control lever increases. On the other hand, the opening area of the meter-in channel of the flow control valve 6*i* for the assist driving is maintained at zero.

As above, in the boom raising fine operation, even if the flow control valve 6*i* for the assist driving is switched upward in FIG. 1, its meter-in channel does not open and its load detection port remains connected to the tank, and the first load pressure detection circuit 131 detects the tank pressure as the maximum load pressure Plmax1. Therefore, the displacement (flow rate) of the main pump 102 is maintained at the minimum level similarly to the case where all the control levers are at the neutral positions.

In contrast, when the flow control valve 6*a* is switched upward in FIG. 1, the load pressure on the bottom side of the boom cylinder 3*a* is detected as the maximum load pressure Plmax3 by the third load pressure detection circuit 133 via the load port of the flow control valve 6*a*, and the maximum load pressure Plmax3 is led to the unloading valve 315 and the differential pressure reducing valve 311. Due to the maximum load pressure Plmax3 led to the unloading valve 315, the set pressure of the unloading valve 315 rises to a pressure as the sum of the maximum load pressure Plmax3 (the load pressure on the bottom side of the boom cylinder 3*a*) and the set pressure Punsp of the spring, and the hydraulic line for discharging the hydraulic fluid from the third hydraulic fluid supply line 305 to the tank is interrupted. Further, due to the maximum load pressure Plmax3 led to the differential pressure reducing valve 311, the differential pressure reducing valve 311 outputs the differential pressure (LS differential pressure) between the pressure P3 in the third hydraulic fluid supply line 305 and the maximum load pressure Plmax3 as the absolute pressure Pls3. The LS differential pressure Pls3 is led to the LS control valve 212*b*. The LS control valve 212*b* compares the LS differential pressure Pls3 with the target LS differential pressure Pgr.

Just after the control lever is operated at the start of the boom raising operation, the load pressure of the boom cylinder 3*a* is transmitted to the third hydraulic fluid supply line 305 and the pressure difference between two lines becomes almost zero, and thus the LS differential pressure Pls3 becomes almost equal to zero. Since the relationship Pls3<Pgr holds, the LS control valve 212*b* switches leftward in FIG. 1 and discharges the hydraulic fluid in the LS control piston 212*c* to the tank. Accordingly, the LS drive pressure Px3 drops and the displacement (flow rate) of the main pump 202 increases. The increase in the flow rate due to the drop in the LS drive pressure Px3 continues until Pls3=Pgr is satisfied. At the point when Pls3=Pgr is satisfied, the LS drive pressure Px3 is maintained at a certain intermediate value between the tank pressure and the constant pilot primary pressure Ppilot generated by the pilot relief valve 32. As above, the main pump 202 delivers the hydraulic fluid at a necessary flow rate according to the demanded flow rate of the flow control valve 6*a*, that is, performs the so-called load sensing control. Consequently, the hydraulic fluid at the flow rate corresponding to the input to the boom control lever is supplied to the bottom side of the boom cylinder 3*a*, by which the boom cylinder 3*a* is driven in the expanding direction.

(b-1) Operation of Torque Feedback Circuit 112*v* (1)

When the displacement (tilting angle) of the main pump 202 is at an intermediate level between the maximum level and the minimum level in the boom raising fine operation, the LS drive pressure Px3 led to the LS control piston 212*c* of the main pump 202 is maintained at a certain value between the tank pressure and the constant pilot primary pressure Ppilot (maximum) of the pilot hydraulic fluid supply line 31*b*. This value is indicated as Px3*b* in FIG. 8, for example.

Assuming that the delivery pressure of the main pump 202 at that time equals P3*g* in FIG. 8, for example, the second set pressure of the second variable pressure reducing valve 112*q* decreases due to the delivery pressure P3*g* of the main pump 202, and the second variable pressure reducing valve 112*q* displays the characteristic indicated by the straight line Q2 in FIG. 8. In this case, the LS drive pressure Px3*b* is directly outputted without being reduced by the second variable pressure reducing valve 112*q*. This state is represented by the point b1 in FIG. 8.

On the other hand, since the LS drive pressure Px3*b* in FIG. 9 is the pressure not reduced by the second variable pressure reducing valve 112*q*, the first variable pressure reducing valve 112*g* displays the characteristic (first pressure reducing characteristic) indicated by the straight line G4 in FIG. 9 and the delivery pressure P3*g* of the main pump 202 is reduced by the first variable pressure reducing valve 112*g* to the pressure P3'*b*. This state is represented by the point B in FIG. 9.

The pressure reduced to P3'*b* is led to the torque feedback piston 112*f* as the output pressure P3*out* of the first variable pressure reducing valve 112*g*. In the torque feedback piston 112*f*, force determined by the product of P3'*b* and the pressure receiving area of the torque feedback piston 112*f* works in the direction for reducing the displacement (tilting angle) of the main pump 102. However, the displacement (tilting angle) of the main pump 102 has already been maintained at the minimum level by the LS control piston 112*c* as mentioned above, and thus this state is maintained.

(b-2) Operation of Torque Feedback Circuit 112*v* (2)

Next, a case of gradually increasing the amount of input to the boom control lever in the boom raising fine operation performed with the delivery pressure of the main pump 202 maintained at P3*g* will be considered below.

In this case, the LS drive pressure Px3 led to the LS control piston 212*c* of the main pump 202 decreases gradually. A certain value of the decreased LS drive pressure Px3 is indicated as Px3*c* in FIG. 8, for example.

As mentioned above, the second variable pressure reducing valve 112*q* has the characteristic indicated by the straight line Q2 in FIG. 8 due to the delivery pressure P3*g* of the main pump 202, and the LS drive pressure Px3*c* is directly outputted without being reduced by the second variable pressure reducing valve 112*q*. This state is represented by the point c in FIG. 8.

On the other hand, since the LS drive pressure Px3*c* in FIG. 9 is the pressure not reduced by the second variable pressure reducing valve 112*q*, the first variable pressure reducing valve 112*g* displays the characteristic (first pressure reducing characteristic) indicated by the straight line G2 in FIG. 9. As the LS drive pressure Px3 decreases from Px3*b* to Px3*c* and the first set pressure of the first variable pressure reducing valve 112*g* increases, the output pressure P3*out* of the first variable pressure reducing valve 112*g* increases gradually and becomes equal to the delivery pressure P3*g* of the main pump 202 when the LS drive pressure Px3 has decreased to Px3*c*. This state is represented by the point C in FIG. 9.

In this state, the delivery pressure P3*g* of the main pump 202 is led to the torque feedback piston 112*f* without being reduced by the first variable pressure reducing valve 112*g*. However, the displacement (tilting angle) of the main pump 102 has already been maintained at the minimum level by the LS control piston 112*c* as mentioned above, and thus this state is maintained.

(b-3) Operation of Torque Feedback Circuit 112*v* (3)

Next, a case where the delivery pressure P3 of the main pump 202 rises further from the state of the point C in FIG. 9 will be considered below.

In this case, when the delivery pressure P3 of the main pump 202 rises to P3*k* in FIG. 9, for example, the pressure P3*k* is reduced to P3'*g* by the characteristic (first pressure reducing characteristic) of the first variable pressure reducing valve 112*g* indicated by the straight line G2.

The pressure reduced to P3'*g* is led to the torque feedback piston 112*f* as the output pressure P3*out* of the first variable pressure reducing valve 112*g*. However, also in this case, the displacement (tilting angle) of the main pump 102 has already been maintained at the minimum level by the LS control piston 112*c* as mentioned above, and thus this state is maintained.

(b-4) Operation of Torque Feedback Circuit 112*v* (4)

Next, consideration will be given to a case where the delivery pressure P3 of the main pump 202 increases from the state of the point B in FIG. 9 in the boom raising fine operation performed with the LS drive pressure remaining at the same value Px3*b*.

When the delivery pressure P3 of the main pump 202 rises from P3*g* to P3*h* in FIG. 8, the second variable pressure reducing valve 112*q* takes on the characteristic indicated by the straight line Q3. In this case, the LS drive pressure Px3*b* at the point b1 is directly outputted without being reduced.

Meanwhile, the first variable pressure reducing valve 112*g* still has the characteristic (first pressure reducing characteristic) of the straight line G4 in FIG. 9, and the delivery pressure P3*h* of the main pump 202 is reduced by the first variable pressure reducing valve 112*g* to the pressure P3'*b*. This state is represented by the point H in FIG. 9.

The pressure reduced to P3'*b* is led to the torque feedback piston 112*f* as the output pressure P3*out* of the first variable pressure reducing valve 112*g*. However, the displacement (tilting angle) of the main pump 102 has already been maintained at the minimum level by the LS control piston 112*c* as mentioned above, and thus this state is maintained.

(b-5) Operation of Torque Feedback Circuit 112*v* (5)

Next, consideration will be given to a case where the delivery pressure P3 of the main pump 202 rises to the maximum delivery pressure P3*max* in the boom raising fine operation performed with the LS drive pressure remaining at the same value Px3*b* with respect to the point B in FIG. 9.

When the delivery pressure of the main pump 202 rises to the maximum delivery pressure P3*max* in FIG. 8, the second set pressure of the second variable pressure reducing valve 112*q* decreases further. The second variable pressure reducing valve 112*q* displays the characteristic indicated by the straight line Q4 of P3=P3*i* (P3*max*) in FIG. 8 and the LS drive pressure Px3*b* is reduced to the pressure Px3'*i* of the point b2.

On the other hand, since the pressure Px3'*i* is the reduced pressure in FIG. 9, the first variable pressure reducing valve 112*g* displays the characteristic (second pressure reducing characteristic) indicated by the straight line Z in FIG. 9. The delivery pressure P3*i* (P3*max*) of the main pump 202 led to the input port of the first variable pressure reducing valve 112*g* is reduced to the pressure P3'*i* of the point I by the pressure reducing characteristic of the first variable pressure reducing valve 112*g* indicated by the straight line Z.

The pressure reduced to P3'*i* is led to the torque feedback piston 112*f* as the output pressure P3*out* of the first variable pressure reducing valve 112*g*. However, the displacement (tilting angle) of the main pump 102 has already been maintained at the minimum level by the LS control piston 112*c* as mentioned above, and thus this state is maintained.

(c) When Boom Control Lever is Operated (Full Operation)

When the boom control lever is operated by the full operation in the direction of expanding the boom cylinder 3*a* (i.e., boom raising direction), for example, the flow control valves 6*a* and 6*i* for driving the boom cylinder 3*a* are switched upward in FIG. 1. As shown in FIG. 2B, the spool strokes of the flow control valves 6*a* and 6*i* exceed S2, the opening area of the meter-in channel of the flow control valve 6*a* is maintained at A1, and the opening area of the meter-in channel of the flow control valve 6*i* reaches A2.

As mentioned above, the load pressure of the boom cylinder 3*a* is detected by the third load pressure detection circuit 133 as the maximum load pressure Plmax3 via the load port of the flow control valve 6*a*. According to the maximum load pressure Plmax3, the delivery flow rate of the main pump 202 is controlled such that Pls3 becomes equal to Pgr, and the hydraulic fluid is supplied from the main pump 202 to the bottom side of the boom cylinder 3*a*.

Meanwhile, the load pressure on the bottom side of the boom cylinder 3*a* is detected by the first load pressure detection circuit 131 as the maximum load pressure Plmax1 via the load port of the flow control valve 6*i* and is led to the unloading valve 115 and the differential pressure reducing valve 111. Due to the maximum load pressure Plmax1 led to the unloading valve 115, the set pressure of the unloading valve 115 rises to a pressure as the sum of the maximum load pressure Plmax1 (the load pressure on the bottom side of the boom cylinder 3*a*) and the set pressure Punsp of the spring, by which the hydraulic line for discharging the hydraulic fluid in the first hydraulic fluid supply line 105 to the tank is interrupted. Further, due to the maximum load pressure Plmax1 led to the differential pressure reducing valve 111, the differential pressure (LS differential pressure) between the pressure P1 in the first hydraulic fluid supply line 105 and the maximum load pressure Plmax1 is outputted by the differential pressure reducing valve 111 as the absolute pressure Pls1. The pressure Pls1 is led to the low-pressure selection valve 112*a* of the regulator 112 and the low pressure side is selected from Pls1 and Pls2 by the low-pressure selection valve 112*a*.

Just after the control lever is operated at the start of the boom raising operation, the load pressure of the boom cylinder 3*a* is transmitted to the first hydraulic fluid supply line 105 and the pressure difference between two lines becomes almost zero, and thus the LS differential pressure Pls1 becomes almost equal to zero. On the other hand, the LS differential pressure Pls2 has been maintained at a level higher than Pgr in this case (Pls2=P2−Plmax2=(Ptank+Punsp)−Ptank=Punsp>Pgr) similarly to the case where the control lever is at the neutral position. Thus, the LS differential pressure Pls1 is selected by the low-pressure selection valve 112*a* as the LS differential pressure Pls12 on the low pressure side and is led to the LS control valve 112*b*. The LS control valve 112*b* compares the LS differential pressure Pls1 with the target LS differential pressure Pgr. In this case, the LS differential pressure Pls1 is almost equal to zero as mentioned above and the relationship Pls1<Pgr holds. Therefore, the LS control valve 112*b* switches rightward in FIG. 1 and discharges the hydraulic fluid in the LS control piston 112*c* to the tank. Accordingly, the LS drive pressure Px3 drops, the displacement (flow rate) of the main pump 102 gradually increases, and the flow rate of the main pump 102 is controlled such that Pls1 becomes equal to Pgr. Consequently, the hydraulic fluid is supplied from the first delivery port 102*a* of the main pump 102 to the bottom side of the boom cylinder 3*a*, and the boom cylinder 3*a* is driven in the expanding direction by the merged hydraulic fluid from the third delivery port 202*a* of the main pump 202 and the first delivery port 102*a* of the main pump 102.

In this case, the second hydraulic fluid supply line 205 is supplied with the hydraulic fluid at the same flow rate as the hydraulic fluid supplied to the first hydraulic fluid supply line 105. However, the hydraulic fluid supplied to the first hydraulic fluid supply line 105 is returned to the tank as a surplus flow via the unloading valve 215. In this case, the second load pressure detection circuit 132 is detecting the tank pressure as the maximum load pressure Plmax2, and thus the set pressure of the unloading valve 215 becomes equal to the set pressure Punsp of the spring and the pressure P2 in the second hydraulic fluid supply line 205 is maintained at the low pressure Punsp. Accordingly, the pressure loss occurring in the unloading valve 215 when the surplus flow returns to the tank is reduced and operation with less energy loss is made possible.

(c-1) Operation of Torque Feedback Circuit 112*v*

When the boom raising full operation is under way, the displacement (tilting angle) of the main pump 202 is at the maximum, and thus the LS drive pressure Px3 led to the LS control piston 212*c* of the main pump 202 becomes almost equal to the tank pressure. This state is represented by the point d in FIG. 8. The pressure at the point d (=tank pressure Ptank) is indicated as Px3*d*.

In this case, irrespective of the value of the delivery pressure P3 of the main pump 202, the LS drive pressure Px3*d* (=tank pressure Ptank) is directly outputted to the first variable pressure reducing valve 112*g* without being reduced by the second variable pressure reducing valve 112*q*.

Since the pressure Px3*d* led to the first variable pressure reducing valve 112*g* is the tank pressure Ptank, the first set pressure of the first variable pressure reducing valve 112*g* becomes equal to the pressure determined by the spring 112*t* (initial value) and the first variable pressure reducing valve 112*g* displays the characteristic (first pressure reducing characteristic) indicated by the straight line G1 in FIG. 9. Assuming that the delivery pressure P3 of the main pump 202 in this case is P3*d* in FIG. 9, the delivery pressure P3*d* is directly outputted without being reduced by the first variable pressure reducing valve 112*g*. This state is represented by the point D in FIG. 9. When the delivery pressure P3 of the main pump 202 increases further to P3*e* in FIG. 9, for example, the delivery pressure P3*e* is reduced to P3'*e* by the characteristic (first pressure reducing characteristic) of the first variable pressure reducing valve 112*g* indicated by the straight line G1. This state is represented by the point E in FIG. 9.

The pressure reduced to P3'*e* is led to the torque feedback piston 112*f* as the output pressure P3*out* of the first variable pressure reducing valve 112*g*. In the torque feedback piston 112*f*, force determined by the product of P3'*e* and the pressure receiving area of the torque feedback piston 112*f* works in the direction for reducing the displacement (tilting angle) of the main pump 102.

In this case, the main pump 202 increases its absorption torque by delivering the hydraulic fluid at a flow rate according to the demanded flow rate of the flow control valve 6*a*. When the absorption torque reaches T3*max* represented by the curve 602 in FIG. 3B, there occurs the so-called saturation state in which the delivery flow rate of the main pump 202 is insufficient for the demanded flow rate. This state is represented by the point X1 in FIG. 3B, for example. When the saturation state occurs, Pls3<Pgr holds and the LS control valve 212*b* is switched to the right-hand position in FIG. 1, and thus the LS drive pressure Px3 becomes equal to the tank pressure Ptank (=Px3*d*). Thus, in the torque feedback circuit 112*v*, the second variable pressure reducing valve 112*q* outputs the tank pressure Ptank (=Px3*d*) without change (point d in FIG. 8) and the first variable pressure reducing valve 112*g* displays the characteristic (first pressure reducing characteristic) indicated by the straight line G1 in FIG. 9. In this case, the delivery pressure P3 of the main pump 202 rises to a pressure higher than the point D in FIG. 9 since the load pressure for the boom raising is relatively high as mentioned above, and the first variable pressure reducing valve 112*g* outputs the limited pressure P3'*e* according to the characteristic of the straight line G1 in FIG. 9. This pressure P3'*e* is transmitted to the torque feedback piston 112*f*. The torque feedback piston 112*f* reduces the maximum torque of the main pump 102 from T12*max* of the curve 502 in FIG. 3A to the value T12*max*−T3*max* of the curve 503 lower than T12*max* by an amount corresponding to the pressure P3'*e*.

With such features, the total torque control, controlling the tilting angle of the main pump 102, is performed such that the absorption torque of the main pump 102 does not exceed T12*max*−T3*max*, by which the sum of the absorption torque of the main pump 102 and the absorption torque of the main pump 202 is inhibited from exceeding the maximum torque T12*max*. Consequently, the stoppage of the prime mover 1 (engine stall) can be prevented.

(d) When Arm Control Lever is Operated (Fine Operation)

When the control lever of the arm operating device (arm control lever) is operated in the direction of expanding the arm cylinder 3*b* (i.e., arm crowding direction), for example, the flow control valves 6*b* and 6*j* for driving the arm cylinder 3*b* are switched downward in FIG. 1. As explained referring to FIG. 2B, the opening area characteristics of the flow control valves 6*b* and 6*j* for driving the arm cylinder 3*b* have been set so as to use the flow control valve 6*b* for the main driving and the flow control valve 6*j* for the assist driving. The flow control valves 6*b* and 6*j* stroke according to the operating pilot pressure outputted by the pilot valve of the operating device.

When the operation on the arm control lever is a fine operation and the strokes of the flow control valves 6*b* and 6*j* are within S2 shown in FIG. 2B, the opening area of the meter-in channel of the flow control valve 6*b* for the main driving increases gradually from zero to A1 as the operation amount (operating pilot pressure) of the arm control lever increases. On the other hand, the opening area of the meter-in channel of the flow control valve 6*j* for the assist driving is maintained at zero.

When the flow control valve 6*b* is switched downward in FIG. 1, the load pressure on the bottom side of the arm cylinder 3*b* is detected by the second load pressure detection circuit 132 as the maximum load pressure Plmax2 via the load port of the flow control valve 6*b* and is led to the unloading valve 215 and the differential pressure reducing valve 211. Due to the maximum load pressure Plmax2 led to the unloading valve 215, the set pressure of the unloading valve 215 rises to a pressure as the sum of the maximum load pressure Plmax2 (the load pressure on the bottom side of the arm cylinder 3*b*) and the set pressure Punsp of the spring, by which the hydraulic line for discharging the hydraulic fluid in the second hydraulic fluid supply line 205 to the tank is interrupted. Further, due to the maximum load pressure Plmax2 led to the differential pressure reducing valve 211, the differential pressure (LS differential pressure) between the pressure P2 in the second hydraulic fluid supply line 205 and the maximum load pressure Plmax2 is outputted by the differential pressure reducing valve 211 as the absolute pressure Pls2. The absolute pressure Pls2 is led to the low-pressure selection valve 112*a* of the regulator 112. The low-pressure selection valve 112*a* selects the low pressure side from Pls1 and Pls2.

Just after the control lever is operated at the start of the arm crowding operation, the load pressure of the arm cylinder 3*b* is transmitted to the second hydraulic fluid supply line 205 and the pressure difference between two lines becomes almost zero, and thus the LS differential pressure Pls2 becomes almost equal to zero. On the other hand, the LS differential pressure Pls1 has been maintained at a level higher than Pgr in this case (Pls1=P1−Plmax1=(Ptank+Punsp)−Ptank=Punsp>Pgr) similarly to the case where the control lever is at the neutral position. Thus, the LS differential pressure Pls2 is selected by the low-pressure selection valve 112*a* as the LS differential pressure Pls12 on the low pressure side and is led to the LS control valve 112*b*. The LS control valve 112*b* compares the LS differential pressure Pls2 with the output pressure Pgr of the prime mover revolution speed detection valve 13 as the target LS differential pressure. In this case, the LS differential pressure Pls2 is almost equal to zero as mentioned above and the relationship Pls2<Pgr holds. Therefore, the LS control valve 112*b* switches rightward in FIG. 1 and discharges the hydraulic fluid in the LS control piston 112*c* to the tank. Thus, the displacement (flow rate) of the main pump 102 gradually increases and the increase in the flow rate continues until Pls2=Pgr is satisfied. Accordingly, the hydraulic fluid at the flow rate corresponding to the input to the arm control lever is supplied from the second delivery port 102*b* of the main pump 102 to the bottom side of the arm cylinder 3*b*, by which the arm cylinder 3*b* is driven in the expanding direction.

In this case, the first hydraulic fluid supply line 105 is supplied with the hydraulic fluid at the same flow rate as the hydraulic fluid supplied to the second hydraulic fluid supply line 205, and the hydraulic fluid supplied to the first hydraulic fluid supply line 105 is returned to the tank as a surplus flow via the unloading valve 115. At that time, the first load pressure detection circuit 131 detects the tank pressure as the maximum load pressure Plmax1, and thus the set pressure of the unloading valve 115 becomes equal to the set pressure Punsp of the spring and the pressure P1 in the first hydraulic fluid supply line 105 is maintained at the low pressure Punsp. Accordingly, the pressure loss occurring in the unloading valve 115 when the surplus flow returns to the tank is reduced and operation with less energy loss is made possible.

Further, since no actuator related to the main pump 202 is driven in this case, similarly to the case where all the control levers are at the neutral positions, the second variable pressure reducing valve 112*q* is set in the state of the point a in FIG. 8, the first variable pressure reducing valve 112*g* is set in the state of the point A in FIG. 9, and the pressure reduced to P3'*j* is led to the torque feedback piston 112*f* as the output pressure P3*out* of the first variable pressure reducing valve 112*g*. Here, P3'*j* is an extremely low pressure below P3*min*, and the maximum torque of the main pump 102 in FIG. 3A is maintained at T12*max* on the curve 502 in FIG. 3A.

(e) When Arm Control Lever is Operated (Full Operation)

When the arm control lever is operated by the full operation in the direction of expanding the arm cylinder 3*b* (i.e., arm crowding direction), for example, the flow control valves 6*b* and 6*j* for driving the arm cylinder 3*b* are switched downward in FIG. 1. As shown in FIG. 2B, the spool strokes of the flow control valves 6*b* and 6*j* exceed S2, the opening area of the meter-in channel of the flow control valve 6*b* is maintained at A1, and the opening area of the meter-in channel of the flow control valve 6*j* reaches A2.

As explained in the above chapter (d), the load pressure on the bottom side of the arm cylinder 3*b* is detected by the second load pressure detection circuit 132 as the maximum load pressure Plmax2 via the load port of the flow control valve 6*b*, and the unloading valve 215 interrupts the hydraulic line for discharging the hydraulic fluid in the second hydraulic fluid supply line 205 to the tank. Since the maximum load pressure Plmax2 is led to the differential pressure reducing valve 211, the LS differential pressure Pls2 is outputted and is led to the low-pressure selection valve 112*a* of the regulator 112.

Meanwhile, the load pressure on the bottom side of the arm cylinder 3*b* is detected by the first load pressure detection circuit 131 as the maximum load pressure Plmax1 (=Plmax2) via the load port of the flow control valve 6*i* and is led to the unloading valve 115 and the differential pressure reducing valve 111. Due to the maximum load pressure Plmax1 led to the unloading valve 115, the hydraulic line for discharging the hydraulic fluid in the first hydraulic fluid supply line 105 to the tank is interrupted by the unloading valve 115. Further, since the maximum load pressure Plmax1 is led to the differential pressure reducing valve 111, the LS differential pressure Pls1 (=Pls2) is led to the low-pressure selection valve 112*a* of the regulator 112.

Just after the control lever is operated at the start of the arm crowding operation, the load pressure of the arm cylinder 3*b* is transmitted to the first and second hydraulic fluid supply lines 105 and 205 and the pressure difference between two lines becomes almost zero in regard to each hydraulic fluid supply line, and thus both of the LS differential pressures Pls1 and Pls2 become almost equal to zero. Thus, Pls1 or Pls2 is selected by the low-pressure selection valve 112*a* as the LS differential pressure Pls12 on the low pressure side and the LS differential pressure Pls12 is led to the LS control valve 112*b*. In this case, both of Pls1 and Pls2 are almost equal to zero as mentioned above and the relationship Pls12<Pgr holds. Therefore, the LS control valve 112*b* switches rightward in FIG. 1 and discharges the hydraulic fluid in the LS control piston 112*c* to the tank. Accordingly, the displacement (flow rate) of the main pump 102 gradually increases and the increase in the flow rate continues until Pls12=Pgr is satisfied. Consequently, the hydraulic fluid at the flow rate corresponding to the input to the arm control lever is supplied from the first and second delivery ports 102*a* and 102*b* of the main pump 102 to the bottom side of the arm cylinder 3*b*, and the arm cylinder 3*b* is driven in the expanding direction by the merged hydraulic fluid from the first and second delivery ports 102*a* and 102*b*.

Further, since no actuator related to the main pump 202 is driven also in this case, similarly to the case where all the control levers are at the neutral positions, the second variable pressure reducing valve 112*q* is set in the state of the point a in FIG. 8, the first variable pressure reducing valve 112*g* is set in the state of the point A in FIG. 9, and the pressure reduced to P3'*j* is led to the torque feedback piston 112*f* as the output pressure P3*out* of the first variable pressure reducing valve 112*g*. Here, P3'*j* is an extremely low pressure below P3*min*, and the maximum torque of the main pump 102 in FIG. 3A is maintained at T12*max* on the curve 502 in FIG. 3A.

With such features, the first torque control section controls the tilting angle of the main pump 102 such that the absorption torque of the main pump 102 does not exceed the maximum torque T12*max*, by which the stoppage of the prime mover 1 (engine stall) can be prevented at times of increase in the load on the arm cylinder 3*b*.

(f) When Horizontally Leveling Work is Performed

The horizontally leveling work is a combination of the boom raising fine operation and the arm crowding full operation. As for the movement of the actuators, the horizontally leveling operation is implemented by expansion of the arm cylinder 3*b* and expansion of the boom cylinder 3*a*.

In the horizontally leveling work, the boom raising is a fine operation. Thus, as explained in the chapter (b), the opening area of the meter-in channel of the flow control valve 6*a* for the main driving of the boom cylinder 3*a* becomes smaller than or equal to A1 and the opening area of the meter-in channel of the flow control valve 6*i* for the assist driving of the boom cylinder 3*a* is maintained at zero. The load pressure of the boom cylinder 3*a* is detected by the third load pressure detection circuit 133 as the maximum load pressure Plmax3 via the load port of the flow control valve 6*a*, and the hydraulic line for discharging the hydraulic fluid in the third hydraulic fluid supply line 305 to the tank is interrupted by the unloading valve 315. Further, the maximum load pressure Plmax3 is fed back to the regulator 212 of the main pump 202, the displacement (flow rate) of the main pump 202 increases according to the demanded flow rate (opening area) of the flow control valve 6*a*, the hydraulic fluid at the flow rate corresponding to the input to the boom control lever is supplied from the third delivery port 202*a* of the main pump 202 to the bottom side of the boom cylinder 3*a*, and the boom cylinder 3*a* is driven in the expanding direction by the hydraulic fluid from the third delivery port 202*a*.

In contrast, the arm control lever is operated by the full operation or full input. Thus, as explained in the above chapter (e), the opening areas of the meter-in channels of the flow control valves 6*b* and 6*j* for the main driving and the assist driving of the arm cylinder 3*b* reach A1 and A2, respectively. The load pressure of the arm cylinder 3*b* is detected by the first and second load pressure detection circuits 131 and 132 respectively as the maximum load pressures Plmax1 and Plmax2 (Plmax1=Plmax2) via the load ports of the flow control valves 6*b* and 6*j*, the hydraulic line for discharging the hydraulic fluid in the first hydraulic fluid supply line 105 to the tank is interrupted by the unloading valve 115, and the hydraulic line for discharging the hydraulic fluid in the second hydraulic fluid supply line 205 to the tank is interrupted by the unloading valve 215. Further, the maximum load pressures Plmax1 and Plmax2 are fed back to the regulator 112 of the main pump 102, the displacement (flow rate) of the main pump 102 increases according to the demanded flow rates of the flow control valves 6*b* and 6*j*, the hydraulic fluid at the flow rate corresponding to the input to the arm control lever is supplied from the first and second delivery ports 102*a* and 102*b* of the main pump 102 to the bottom side of the arm cylinder 3*b*, and the arm cylinder 3*b* is driven in the expanding direction by the merged hydraulic fluid from the first and second delivery ports 102*a* and 102*b*.

In the horizontally leveling work, the load pressure of the arm cylinder 3*b* is generally low and the load pressure of the boom cylinder 3*a* is generally high in many cases. In this embodiment, actuators differing in the load pressure are driven by separate pumps, namely, the boom cylinder 3*a* is driven by the main pump 202 and the arm cylinder 3*b* is driven by the main pump 102, in the horizontally leveling work. Therefore, the wasteful energy consumption caused by the pressure loss in the pressure compensating valve 7*b* on the low load side, occurring in the conventional one-pump load sensing system which drives multiple actuators differing in the load pressure by use of one pump, does not occur in the hydraulic drive system of this embodiment.

(f-1) Operation of Torque Feedback Circuit 112*v*

Assuming that the LS drive pressure Px3 equals Px3*b* of the point b1 in FIG. 8 and the delivery pressure of the main pump 202 equals P3*g* in FIG. 8 in the boom raising fine operation in the horizontally leveling work, the LS drive pressure Px3*b* is not reduced by the second variable pressure reducing valve 112*q*, and thus the first variable pressure reducing valve 112*g* displays the characteristic (first pressure reducing characteristic) indicated by the straight line G4 in FIG. 9 and the delivery pressure P3*g* of the main pump 202 is reduced to the pressure P3'*b* (point B) by the pressure reducing characteristic of the first variable pressure reducing valve 112*g* indicated by the straight line G4 as explained in the chapter (b-1).

The pressure reduced to P3'*b* is led to the torque feedback piston 112*f* as the output pressure P3*out* of the first variable pressure reducing valve 112*g*. In the torque feedback piston 112*f*, force determined by the product of P3'*b* and the pressure receiving area of the torque feedback piston 112*f* works in the direction for reducing the displacement (tilting angle) of the main pump 102.

Here, assuming that the main pump 202 is operating at the point X2 in FIG. 3B, the torque feedback circuit 112*v* modifies the delivery pressure P3*g* of the main pump 202 to a value simulating the absorption torque T3*g* of the point X2 and outputs the modified pressure, and the torque feedback piston 112*f* reduces the maximum torque of the main pump 102 from T12*max* on the curve 502 in FIG. 3A to T12*max*−T3*gs* on the curve 504 in FIG. 3A (T3*gs*≈T3*g*).

With such features, even when the arm control lever is operated by the full operation in the horizontally leveling work, the total torque control, controlling the tilting angle of the main pump 102, is performed such that the absorption torque of the main pump 102 does not exceed T12*max*−T3*gs*, by which the sum of the absorption torque of the main pump 102 and the absorption torque of the main pump 202 is inhibited from exceeding the maximum torque T12*max*. Consequently, the stoppage of the prime mover 1 (engine stall) can be prevented.

(g) When Boom Raising Fine Operation is Performed in Load Lifting Work

The load lifting work is a type of work in which a wire is attached to a hook formed on the bucket and a load is lifted with the wire and moved to a different place. Also when the boom raising fine operation is performed in the load lifting work, the hydraulic fluid is supplied from the third delivery port 202*a* of the main pump 202 to the bottom side of the boom cylinder 3*a* by the load sensing control performed by the regulator 212 and the boom cylinder 3*a* is driven in the expanding direction as explained in the chapter (b). However, the boom raising in the load lifting work is work that needs extreme care, and thus the operation amount of the control lever is extremely small and there are cases where the minimum flow rate obtained by the minimum tilting angle q3*min* of the main pump 202 is sufficient for the demanded flow rate of the flow control valve. In such cases, Pls3>Pgr holds, the LS control valve 212*b* is positioned at the left-hand position in FIG. 1, and the LS drive pressure Px3 becomes equal to the constant pilot primary pressure Ppilot generated by the pilot relief valve 32. Thus, the first variable pressure reducing valve 112*g* of the torque feedback circuit 112*v* displays the characteristic (second pressure reducing characteristic) indicated by the straight line Z in FIG. 9 similarly to the aforementioned case (a) where all the control levers are at the neutral positions.

Here, the load in the load lifting work is heavy and the delivery pressure P3 of the main pump 202 becomes high like the pressure P31 in FIG. 9 in many cases. Further, in the load lifting work, there are cases where the position of the load in the swing direction is changed by driving the swing motor 3*c* or the position of the load in the longitudinal direction is changed by driving the arm cylinder 3*b* simultaneously with the boom raising fine operation. In such combined operations of the boom raising fine operation and the swing/arm operation, the hydraulic fluid is delivered also from the main pump 102 and the horsepower of the prime mover 1 is consumed by both of the main pumps 102 and 202.

If the torque feedback circuit 112*v* is not equipped with the second variable pressure reducing valve 112*q* in this embodiment, the output pressure of the torque feedback circuit 112*v* is limited to the output pressure P3'*a* of the first variable pressure reducing valve 112*g* as indicated by the straight line G5 in FIG. 9 and the torque feedback circuit 112*v* outputs the pressure P3'*a* lower than the pressure P31 in FIG. 9. In this case, there is a danger that precise feedback of the absorption torque of the main pump 202 to the main pump 102' side becomes impossible, total torque consumption of the main pumps 102 and 202 becomes excessive, and the engine stall occurs.

In this embodiment, the torque feedback circuit 112*v* is equipped with the second variable pressure reducing valve 112*q*. Thus, even when the delivery pressure P3 of the main pump 202 becomes high like P31 in FIG. 9, the torque feedback circuit 112*v* outputs a relatively high pressure corresponding to the point L on the straight line Z and the maximum torque of the main pump 102 is controlled to decrease correspondingly. Since the absorption torque of the main pump 202 is precisely fed back to the main pump 102' side as above, the total torque consumption of the main pumps 102 and 202 does not become excessive and the engine stall can be prevented even when a combined operation of the boom raising fine operation and the swing/arm operation is performed in the load lifting work.

Effect

In this embodiment configured as above, not only when the main pump 202 (second hydraulic pump) is in the operational state of undergoing the limitation by the torque control and operating at the maximum torque T3*max* of the torque control like the point X1 in FIG. 3B but also when the main pump 202 is in the operational state of not undergoing the limitation by the torque control and performing the displacement control by means of the load sensing control, the delivery pressure P3 of the main pump 202 is modified by the torque feedback circuit 112*v* to the absorption torque of the main pump 202 and the maximum torque T12*max* is modified by the torque feedback piston 112*f* (third torque control actuator) to decrease by an amount corresponding to the modified delivery pressure. As above, the absorption torque of the main pump 202 is detected precisely by use of a purely hydraulic structure (torque feedback circuit 112*v*). By feeding back the absorption torque to the main pump 102's side, the total torque control can be performed precisely and the rated output torque Terate of the prime mover 1 can be utilized efficiently.

Figure 10:
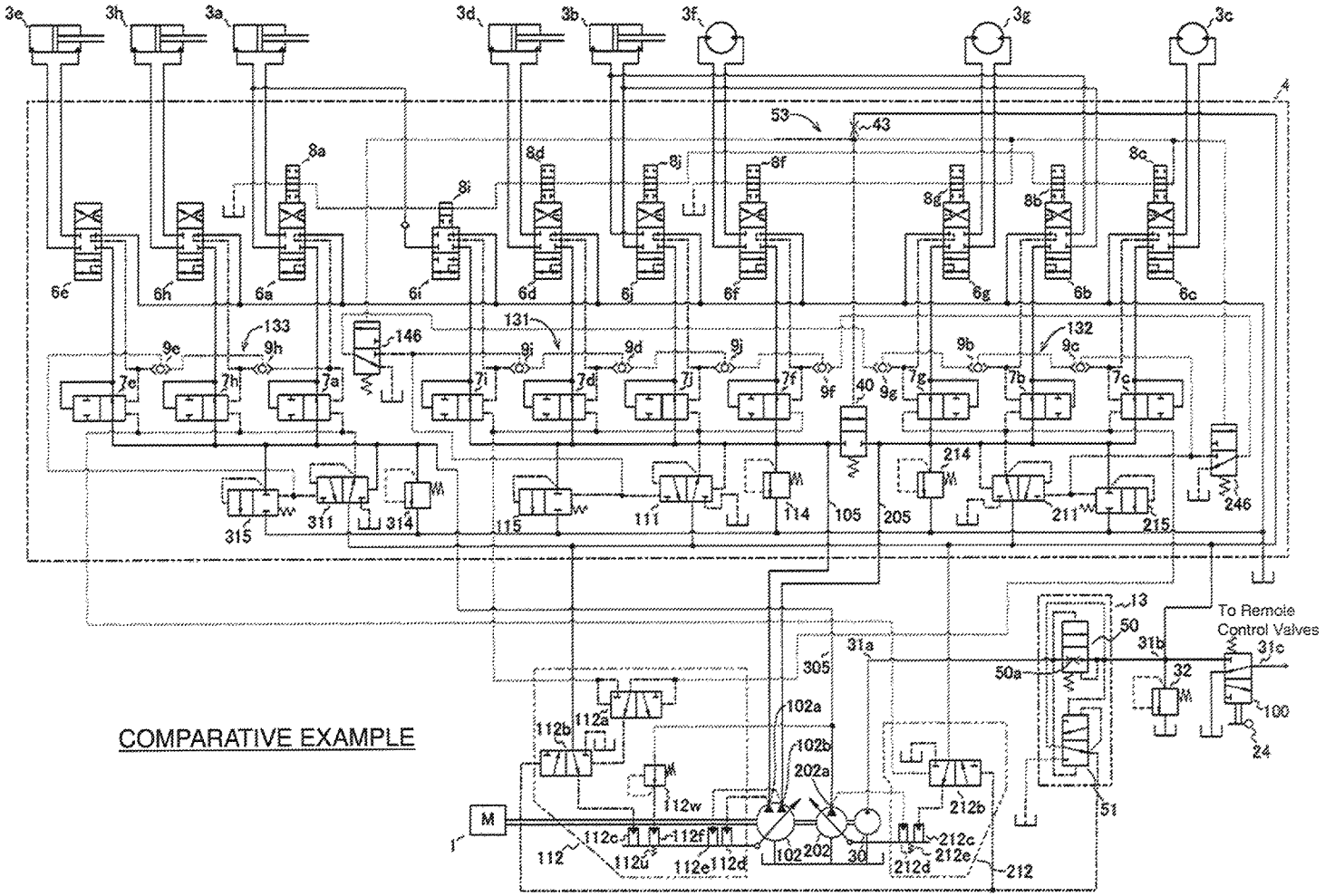
FIG. 10 is a schematic diagram showing a comparative example for explaining the effects of the embodiment.

FIG. 10 is a schematic diagram showing a comparative example for explaining the above-described effects of this embodiment. In this comparative example, the torque feedback circuit 112*v* of the regulator 112 in the first embodiment of the present invention shown in FIG. 1 is replaced with a pressure reducing valve 112*w* (corresponding to the pressure reducing valve 14 in Patent Document 2).

In the comparative example shown in FIG. 10, the set pressure of the pressure reducing valve 112*w* is constant and has been set at the same value as the initial value of the set pressure of the first variable pressure reducing valve 112*g* shown in FIG. 1. In this case, the pressure reducing valve 112*w* displays a characteristic like the straight line G1 in FIG. 9 and when the delivery pressure P3 of the main pump 202 rises, the output pressure of the pressure reducing valve 112*w* changes like the straight lines G0 and G1 in FIG. 9 irrespective of the LS drive pressure Px3.

In this comparative example, when the main pump 202 is operating at the point X1 on the curve 602 of the maximum torque T3*max* in FIG. 3B and the LS drive pressure Px3 equals the tank pressure as in the boom raising full operation (c), for example, the pressure reducing valve 112*w* modifies the delivery pressure of the main pump 202 to the pressure P3'*e* on the straight line G1 in FIG. 9 and outputs the modified pressure similarly to the first variable pressure reducing valve 112*g* of the torque feedback circuit 112*v* shown in FIG. 1 and the torque feedback piston 112*f* reduces the maximum torque of the main pump 102 from T12*max* to T12*max*−T3*max* as indicated by the curve 503 in FIG. 3A, achieving the same effects as this embodiment.

However, when the main pump 202 is operating at the point X2 in FIG. 3B and the LS drive pressure Px3 is an intermediate pressure between the tank pressure and the pilot primary pressure Ppilot as in the horizontally leveling work, the pressure reducing valve 112*w* modifies the delivery pressure of the main pump 202 to the pressure P3'*e* on the straight line G1 in FIG. 9 and outputs the modified pressure similarly to the case where the main pump 202 operates at the point X1. Thus, the torque feedback piston 112*f* excessively reduces the maximum torque of the main pump 102 from T12*max* to T12*max*−T3*max* as indicated by the curve 503 in FIG. 3A even though the absorption torque of the main pump 202 is T3*g* lower than T3*max*.

In this embodiment, when the main pump 202 is operating at the point X2 in FIG. 3B and the LS drive pressure Px3 is an intermediate pressure between the tank pressure and the pilot primary pressure Ppilot as explained in the chapter (f-1) of the horizontally leveling work, the torque feedback circuit 112*v* displays the characteristic of the straight line G2 in FIG. 9, for example, modifies the delivery pressure of the main pump 202 to a value simulating the absorption torque (e.g., T3*g*) of the main pump 202 and outputs the modified pressure (e.g., P3'*g* in FIG. 9), and the torque feedback piston 112*f* reduces the maximum torque of the main pump 102 from T12*max* on the curve 502 in FIG. 3A to absorption torque on the curve 504 (e.g., T12*max*−T3*gs*) in FIG. 3A (T3*gs*≈T3*g*) as mentioned above. Consequently, the absorption torque available to the main pump 202 becomes greater than T12*max*−T3*max* achieved in the comparative example.

As above, in this embodiment, the total horsepower control for preventing the stoppage of the prime mover 1 (engine stall) can be performed precisely and the output torque Terate of the prime mover 1 can be utilized efficiently by having the torque feedback circuit 112*v* precisely feed back the absorption torque T3*max* or T3*g* of the main pump 202 to the main pump 102's side.

Further, in this embodiment in which the torque feedback circuit 112*v* is equipped with the second variable pressure reducing valve 112*q*, even when the delivery pressure P3 of the main pump 202 becomes high like P31 in FIG. 9, the torque feedback circuit 112*v* outputs a relatively high pressure corresponding to the point L on the straight line Z and the maximum torque of the main pump 102 is controlled to decrease correspondingly. Since the absorption torque of the main pump 202 is precisely fed back to the main pump 102' side even when the main pump 202 operates at the minimum tilting angle as explained above, the total torque consumption of the main pumps 102 and 202 does not become excessive and the engine stall can be prevented when a combined operation of the boom raising fine operation and the swing/arm operation is performed in the load lifting work.

Other Examples

The embodiment described above is just an example for illustration and a variety of modifications are possible within the spirit of the present invention.

For example, while the hydraulic line 112*k* for leading the LS drive pressure Px3 to the input port of the second variable pressure reducing valve 112*q* is equipped with the restrictor 112*r* for absorbing vibration of the LS drive pressure Px3 and stabilizing the pressure when the LS drive pressure Px3 is vibrational in the above embodiment, the restrictor 112*r* is employed assuming cases where the LS drive pressure Px3 is vibrational. The restrictor 112*r* can be left out in cases where the vibration of the LS drive pressure Px3 is within an extent not significantly affecting the stability of the outputs of the first and second variable pressure reducing valves 112*g* and 112*q*.

While the hydraulic line 112*j* for leading the delivery pressure of the main pump 202 to the first and second variable pressure reducing valves 112*g* and 112*q* is equipped with no restrictor in the above embodiment, the hydraulic line 112*j* may also be equipped with a restrictor in cases where the outputs of the first and second variable pressure reducing valves 112*g* and 112*q* cannot be stabilized by just providing the hydraulic line 112*k* with the restrictor 112*r*.

While the description of the above embodiment has been given of a case where the first hydraulic pump is the split flow type hydraulic pump 102 having the first and second delivery ports 102*a* and 102*b*, the first hydraulic pump can also be a variable displacement hydraulic pump having a single delivery port.

Further, while the first pump control unit has been assumed to be the regulator 112 including the load sensing control section (the low-pressure selection valve 112*a*, the LS control valve 112*b* and the LS control piston 112*c*) and the torque control section (the torque control pistons 112*d* and 112*e* and the spring 112*u*), the load sensing control section in the first pump control unit is not essential. Other types of control methods such as the so-called positive control or negative control may also be employed as long as the displacement of the first hydraulic pump can be controlled according to the operation amount of a control lever (the opening area of a flow control valve–the demanded flow rate).

Furthermore, the load sensing system in the above embodiment is just an example and can be modified in various ways. For example, while a differential pressure reducing valve outputting a pump delivery pressure and a maximum load pressure as absolute pressures is employed, and the target compensation pressure is set by leading the output pressure of the differential pressure reducing valve to a pressure compensating valve, and the target differential pressure of the load sensing control is set by leading the output pressure of the differential pressure reducing valve to an LS control valve in the above embodiment, it is also possible to lead the pump delivery pressure and the maximum load pressure to a pressure control valve or an LS control valve through separate hydraulic lines.

DESCRIPTION OF REFERENCE CHARACTERS

1: Prime mover
102: Main pump of variable displacement type (first hydraulic pump)
102*a*, 102*b*: first and second delivery ports
112: Regulator (first pump control unit)
112*a*: Low-pressure selection valve
112*b*: LS control valve 112*b*
112*c*: LS control piston
112*d*, 112*e*: Torque control pistons (first torque control actuators)
112*f*: Torque feedback piston (third torque control actuator)
112*g*: First variable pressure reducing valve
112*h*, 112*i*: Pressure receiving parts
112*j*, 112*k*: Hydraulic lines
112*n*, 112*p*: Hydraulic lines
112*r*: Restrictor
112*q*: Second variable pressure reducing valve
112*s*, 112*t*: Springs
112*u*: Spring (first biasing means)
112*v*: Torque feedback circuit
202: Main pump of variable displacement type (second hydraulic pump)
202*a*: Third delivery port
212: Regulator (second pump control unit)
212*b*: LS control valve
212*c*: LS control piston (load sensing control actuator)
212*d*: Torque control piston (second torque control actuator)
212*e*: Spring (second biasing means)
115: Unloading valve
215: Unloading valve
315: Unloading valve
111, 211, 311: Differential pressure reducing valves
146, 246: Second and third selector valves
3*a*-3*h*: Actuators
4: Control valve unit
6*a*-6*j*: Flow control valves
7*a*-7*j*: Pressure compensating valves
8*a*-8*j*: Operation detection valves
9*b*-9*j*: Shuttle valves
13: Prime mover revolution speed detection valve
24: Gate lock lever
30: Pilot pump
31*a*, 31*b*, 31*c*: Pilot hydraulic fluid supply line
32: Pilot relief valve
40: Third selector valve
53: Travel combined operation detection hydraulic line
43: Restrictor
100: Gate lock valve
122, 123, 124*a*, 124*b*: Operating devices
131, 132, 133: First, second, and third load pressure detection circuits

The invention claimed is:

1. A hydraulic drive system for a construction machine, comprising:

a prime mover;

a first hydraulic pump of a variable displacement type driven by the prime mover;

a second hydraulic pump of the variable displacement type driven by the prime mover;

a plurality of actuators driven by a hydraulic fluid delivered by the first and second hydraulic pumps;

a plurality of flow control valves that control flow rates of the hydraulic fluid supplied from the first and second hydraulic pumps to the actuators;

a plurality of pressure compensating valves each of which controls a differential pressure across a corresponding one of the flow control valves;

a first pump control unit that controls a delivery flow rate of the first hydraulic pump, the first pump control unit including a first torque control section that controls a displacement of the first hydraulic pump in such a manner that an absorption torque of the first hydraulic pump does not exceed a first maximum torque when at least one of a delivery pressure and the displacement of the first hydraulic pump increases and the absorption torque of the first hydraulic pump increases; and a second pump control unit that controls a delivery flow rate of the second hydraulic pump, the second pump control unit including a second torque control section that controls a displacement of the second hydraulic pump in such a manner that an absorption torque of the second hydraulic pump does not exceed a second maximum torque when at least one of a delivery pressure and the displacement of the second hydraulic pump increases and the absorption torque of the second hydraulic pump increases, and a load sensing control section that controls the displacement of the second hydraulic pump in such a manner that the delivery pressure of the second hydraulic pump becomes higher by a target differential pressure than a maximum load pressure of the actuators driven by the hydraulic fluid delivered by the second hydraulic pump when the absorption torque of the second hydraulic pump is lower than the second maximum torque, wherein:

the first torque control section includes a first torque control actuator that is supplied with the delivery pressure of the first hydraulic pump and controls the displacement of the first hydraulic pump in such a manner that the absorption torque of the first hydraulic pump decreases as the delivery pressure of the first hydraulic pump increases, and first biasing means that sets the first maximum torque;

the second torque control section includes a second torque control actuator that is supplied with the delivery pressure of the second hydraulic pump and controls the displacement of the second hydraulic pump in such a manner that the absorption torque of the second hydraulic pump decreases as the delivery pressure of the second hydraulic pump increases, and second biasing means that sets the second maximum torque;

the load sensing control section includes a control valve that changes a load sensing drive pressure in such a manner that the load sensing drive pressure decreases as a differential pressure between the delivery pressure of the second hydraulic pump and the maximum load pressure decreases below the target differential pressure, and a load sensing control actuator that controls the displacement of the second hydraulic pump in such a manner that the delivery flow rate increases as the load sensing drive pressure decreases;

the first pump control unit further includes a torque feedback circuit that is supplied with the delivery pressure of the second hydraulic pump and the load sensing drive pressure, modifies the delivery pressure of the second hydraulic pump based on the delivery pressure of the second hydraulic pump and the load sensing drive pressure to achieve a characteristic simulating the absorption torque of the second hydraulic pump in both of when the second hydraulic pump operates at the second maximum torque under the control by the second torque control section and when the absorption torque of the second hydraulic pump is lower than the second maximum torque and the load sensing control section controls the displacement of the second hydraulic pump, and outputs the modified pressure, and a third torque control actuator that is supplied with an output pressure of the torque feedback circuit and controls the displacement of the first hydraulic pump so as to decrease the displacement of the first hydraulic pump and thereby decrease the first maximum torque as the output pressure of the torque feedback circuit increases;

the torque feedback circuit includes a first variable pressure reducing valve that is supplied with the delivery pressure of the second hydraulic pump, outputs the delivery pressure of the second hydraulic pump without change when the delivery pressure of the second hydraulic pump is lower than or equal to a first set pressure, and reduces the delivery pressure of the second hydraulic pump to the first set pressure and outputs the reduced pressure when the delivery pressure of the second hydraulic pump is higher than the first set pressure, and a second variable pressure reducing valve that is supplied with the load sensing drive pressure and the delivery pressure of the second hydraulic pump, outputs the load sensing drive pressure without change when the load sensing drive pressure is lower than or equal to a second set pressure, and reduces the load sensing drive pressure to the second set pressure and outputs the reduced pressure when the load sensing drive pressure is higher than the second set pressure, while changing the second set pressure in such a manner that the second set pressure decreases as the delivery pressure of the second hydraulic pump increases; and the first variable pressure reducing valve includes a pressure receiving part that is supplied with an output pressure of the second variable pressure reducing valve and changes the first set pressure in such a manner that the first set pressure decreases as the output pressure of the second variable pressure reducing valve increases.

2. The hydraulic drive system for a construction machine according to claim 1, wherein the torque feedback circuit further includes a restrictor that is provided in a hydraulic line for leading the load sensing drive pressure to the second variable pressure reducing valve to absorb vibration of the load sensing drive pressure thereby to stabilize the pressure.

* * * * *